US009315754B2

(12) United States Patent
Brewer et al.

(10) Patent No.: US 9,315,754 B2
(45) **Date of Patent: *Apr. 19, 2016**

(54) COMPOSITIONS

(71) Applicant: Shell Oil Company, Houston, TX (US)

(72) Inventors: Mark Lawrence Brewer, Chester (GB); Roger Francis Cracknell, Chester (GB); Tor Kit Goh, Damansara Heights (MY)

(73) Assignee: Shell Oil Company, Houston, TX (US)

( * ) Notice: Subject to any disclaimer, the term of this patent is extended or adjusted under 35 U.S.C. 154(b) by 41 days.

This patent is subject to a terminal disclaimer.

(21) Appl. No.: 14/134,297

(22) Filed: Dec. 19, 2013

(65) Prior Publication Data

US 2014/0182192 A1 Jul. 3, 2014

(30) Foreign Application Priority Data

Dec. 27, 2012 (EP) ..... 12199500
Sep. 13, 2013 (EP) ..... 13184381

(51) Int. Cl.
*C10L 10/12* (2006.01)
*C10L 1/183* (2006.01)
(Continued)

(52) U.S. Cl.
CPC ..... *C10L 10/12* (2013.01); *C10L 1/143* (2013.01); *C10L 1/18* (2013.01); *C10L 10/00* (2013.01);
(Continued)

(58) Field of Classification Search
CPC ..... C10L 10/12; C10L 1/143; C10L 1/18; C10L 10/00; C10L 1/198; C10L 1/231; C10L 1/232; C10L 1/1811; C10L 1/223; C08B 37/0012; C08B 37/0015
USPC ..... 44/322, 426
See application file for complete search history.

(56) References Cited

U.S. PATENT DOCUMENTS 3,314,884 A 4/1967 Cover
3,453,257 A * 7/1969 Parmerter et al. ..... 536/46
(Continued)

FOREIGN PATENT DOCUMENTS

EP 948584 10/1999
FR 2484252 12/1981
(Continued)

OTHER PUBLICATIONS

EIC Search Jan. 2015.*
(Continued)

*Primary Examiner* — Pamela H Weiss

(57) ABSTRACT

An additive composition for use in a diesel fuel formulation, comprising a cetane improver in an inclusion complex with a modified cyclodextrin of formula (I):

(I)

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen. Also provided is a diesel fuel formulation comprising the additive composition, and the use of a modified cyclodextrin (I) as a vehicle for a cetane improver in an additive composition or diesel fuel formulation.

14 Claims, 5 Drawing Sheets

(51) Int. Cl.

| | |
|---|---|
| ***C10L 1/182*** | (2006.01) |
| ***C10L 1/10*** | (2006.01) |
| ***C10L 1/08*** | (2006.01) |
| ***C10L 1/14*** | (2006.01) |
| ***C10L 10/00*** | (2006.01) |
| *C10L 1/18* | (2006.01) |
| *C10L 1/223* | (2006.01) |
| *C10L 1/232* | (2006.01) |
| *C10L 1/198* | (2006.01) |
| *C10L 1/23* | (2006.01) |

(52) U.S. Cl.

CPC ..... *C10L 1/1811* (2013.01); *C10L 1/198* (2013.01); *C10L 1/223* (2013.01); *C10L 1/231* (2013.01); *C10L 1/232* (2013.01)

(56) References Cited

U.S. PATENT DOCUMENTS

| | | | | |
|---|---|---|---|---|
| 3,679,582 | A * | 7/1972 | Waganaar et al. | 507/90 |
| 4,515,740 | A | 5/1985 | Schuettenberg et al. | |
| 5,199,959 | A | 4/1993 | Sung et al. | |
| 5,226,925 | A | 7/1993 | DeRosa et al. | |
| 5,349,188 | A | 9/1994 | Maggard | |
| 5,470,358 | A | 11/1995 | Gaughan | |
| 5,482,520 | A | 1/1996 | Alam et al. | |
| 6,110,306 | A * | 8/2000 | Consaga | 149/108 |
| 6,805,816 | B1 | 10/2004 | Groenendaal et al. | |
| 6,858,048 | B1 | 2/2005 | Jimeson et al. | |
| 2001/0003231 | A1 | 6/2001 | Ford et al. | |
| 2004/0099838 | A1 | 5/2004 | Leck et al. | |
| 2005/0035045 | A1 | 2/2005 | Colucci | |
| 2006/0225340 | A1 | 10/2006 | Gaughan et al. | |
| 2007/0225490 | A1* | 9/2007 | Ching et al. | 536/123.1 |
| 2008/0168706 | A1 | 7/2008 | Rusek et al. | |
| 2010/0160623 | A1 | 6/2010 | Strassburger | |

FOREIGN PATENT DOCUMENTS

| | | |
|---|---|---|
| JP | 1210497 | 8/1989 |
| RU | 2235117 | 8/2004 |
| WO | 9940166 | 8/1999 |
| WO | 0049108 | 8/2000 |
| WO | 0200812 | 1/2002 |
| WO | 0222766 | 3/2002 |
| WO | 03004146 | 1/2003 |
| WO | 03018726 | 3/2003 |
| WO | 03018727 | 3/2003 |
| WO | 03018988 | 3/2003 |
| WO | 03083017 | 10/2003 |
| WO | 2005003265 | 1/2005 |
| WO | 2005052096 | 6/2005 |
| WO | 2005123238 | 12/2005 |
| WO | 2006105025 | 10/2006 |
| WO | 2008073118 | 6/2008 |
| WO | 2008076759 | 6/2008 |
| WO | 2009050287 | 4/2009 |
| WO | 2010001341 | 1/2010 |
| WO | 2010014528 | 2/2010 |
| WO | 2010132209 | 11/2010 |

OTHER PUBLICATIONS

EIC Search B Jan. 2015.*

Hedges A R: "Industrial applications of cyclodextrins", Chemical Reviews, American Chemical Society, US, vol. 98, No. 5, pp. 2035-2044, 1998, XP002453286.

Menger, F.M. et al.: "Chemistry of a heptane-soluble cyclodextrin derivative", Tetrahedron Letters, vol. 26, No. 3, 1985, pp. 267-270, XP002721690.

Nakai, Y. et al.: "Effects of grinding on the physical and chemical properties of crystalline medicinals with microcrystalline cellulose V: comparison with tri-O-methyl-beta-cyclodextrin ground mixtures", Chem. Pharm. Bull. vol. 28, No. 5, 1980, pp. 1552-1558, XP002696857.

Marques; "A review on cyclodextrin encapsulation of essential oils and volatiles"; Flavour Frager J.; vol. 25; pp. 313-326; 2010.

Chemical Reviews; vol. 98; pp. 2035-2044, (1998).

* cited by examiner

COMPOSITIONS

CROSS-REFERENCE TO RELATED APPLICATIONS

This application claims the benefit of European Application No. 12199500.5, filed on Dec. 27, 2012, and European Application No. 13184381.5, filed on Sep. 13, 2013, the disclosures of which are incorporated by reference herein in their entirety.

TECHINIAL FIELD

This present disclosure generally relates to additive compositions for use in diesel fuel formulations, and to diesel fuel formulations containing the additive compositions. It also relates to the use of certain compounds in additive compositions and in diesel fuel formulations, for new purposes.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of any prior art.

Many diesel fuel formulations contain cetane improving additives, also known as cetane boosters, cetane improvers or ignition improvers, to increase their cetane numbers. The cetane number of a fuel is a measure of its ease of ignition. With a lower cetane number fuel, a compression ignition (diesel) engine tends to be more difficult to start and may run more noisily when cold. There is a general preference therefore for a diesel fuel formulation to have a high cetane number, and as such automotive diesel fuel specifications generally stipulate a minimum cetane number.

Typically, cetane improving additives are used in the form of an additive package which contains one or more functionally active substances in a suitable solvent vehicle.

It is often desirable to reduce the concentrations of additives in diesel fuel formulations. This may be driven by consumer preferences and/or by technical or economic considerations. In cases it may be driven by a desire to reduce side effects associated with a particular additive, or with an interaction between two or more additives which are present in a fuel formulation.

Efforts to achieve reduced additive levels have tended to focus on providing additives with higher activities, or synergistic combinations of additives, or additives with higher stabilities which can thereby provide performance-enhancing benefits for longer periods. Attempts have also been made to control the release of additives into fuel formulations, so as to enhance their effects at a location or time point where they can be most useful: such attempts include the incorporation of additives into insoluble gels, polymers and other solid matrices (eg WO 2010/132209, WO 2010/014528, WO 2006/105025, WO 2005/123238, WO 2005/052096, WO 2005/003265, WO 2003/083017, WO 2003/018727, WO 02/00812, WO 99/40166 and U.S. Pat. No. 4,515,740); their immobilisation onto filter supports (WO 2003/018988) or ion exchange resins (U.S. 2005/0035045); their encapsulation in lipid vesicles (WO 2000/49108) or microcapsules (JP 1210497 and WO 2003/004146); and even their delivery via dispensing containers, as described in WO 2003/018726.

According, there is still a need for alternative forms of cetane improving additives which can be used at lower levels and/or which can more efficiently modify the properties and/or performance of a diesel fuel formulation.

SUMMARY

It has now been found that certain types of compound can be used as delivery vehicles for cetane improving additives in diesel fuel formulations, and that these compounds may be able to improve the efficiency of the additives, in use, and thus to facilitate the use of lower additive concentrations.

According to a first aspect, there is provided an additive composition for use in a diesel fuel formulation, the additive composition comprising (i) a cetane improver and (ii) a modified cyclodextrin of formula (I):

(I)

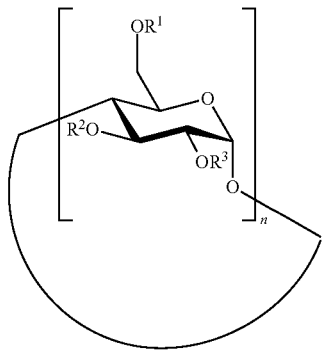

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the cetane improver being present as a guest molecule within a host molecule of the modified cyclodextrin (I), in the form of an inclusion complex.

The features and advantages of the present disclosure will be readily apparent to one having ordinary skill in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1A:
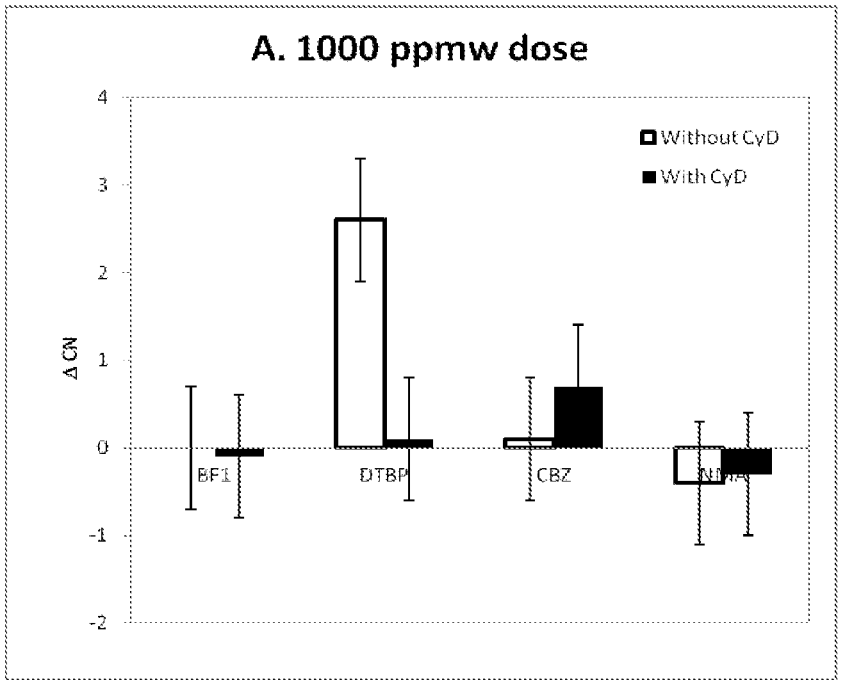
FIGS. 1A to 1D are bar charts showing the results of the cetane number measurements conducted in Examples 1 to 3 below.
Figure 1B:
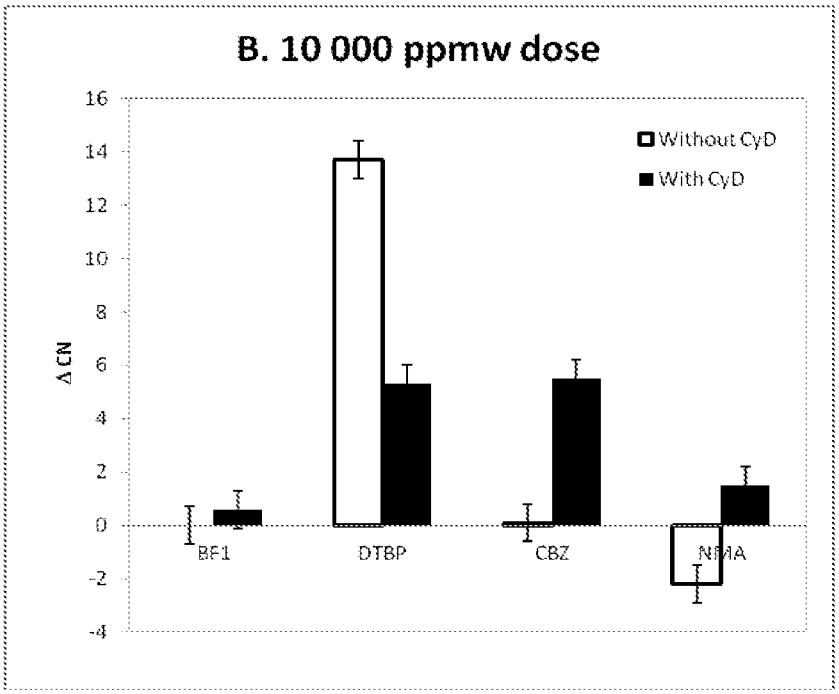
Figure 1C:
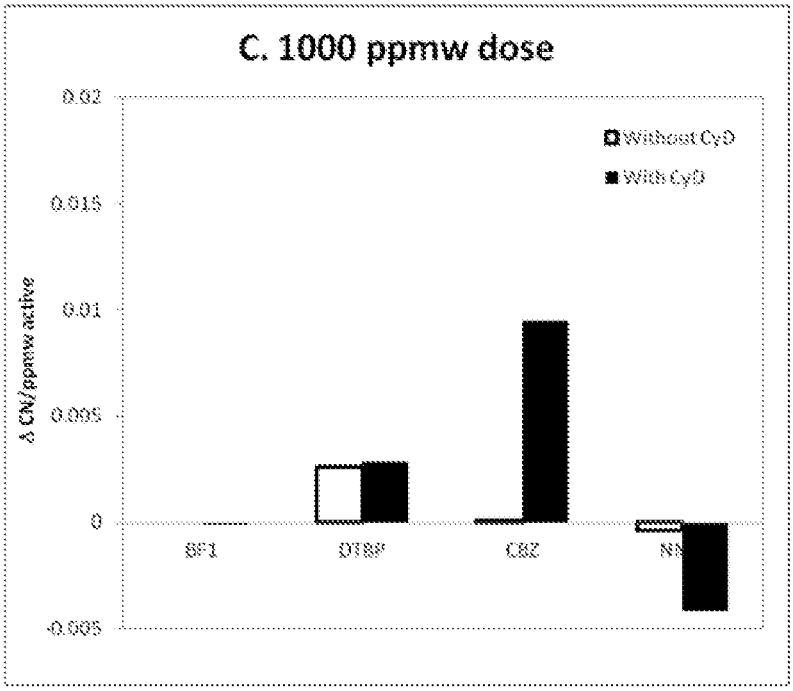
Figure 1D:
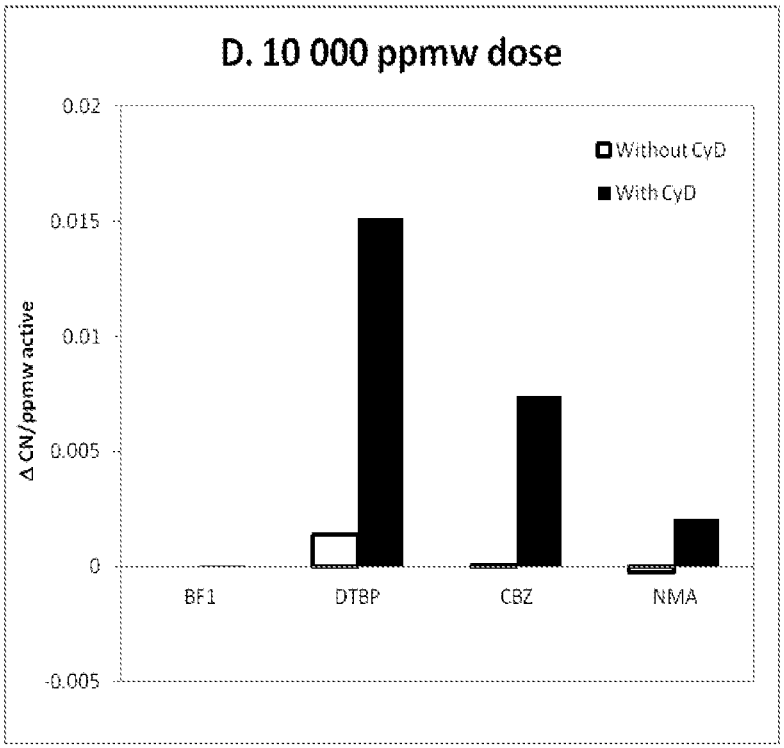

It has been found that modified cyclodextrins of formula (I) can be highly suitable vehicles for cetane improving additives. The cyclodextrin molecule naturally forms a cavity which is able to accommodate an additive molecule of an appropriate size and polarity. The capture and release of the additive "guest" molecule by the cyclodextrin "host" molecule is reversible, as it does not involve the formation of covalent or ionic bonds, relying instead on hydrogen bonding, van der Waals interactions and/or electrostatic interactions. Encapsulation of a cetane improving additive in this way appears not to impair its effect on a diesel fuel formulation to which it is added. The encapsulation can however protect the additive, to a degree, from external influences, and can thus help to improve the stability of the additive and/or to reduce the risk of unfavourable interactions with other species present in the formulation.

The inner cavity of the cyclodextrin has solubility characteristics similar to those of ethanol, making it attractive to a wide range of both hydrophilic and hydrophobic "guest" molecules. The solubility of the cyclodextrin in its own environment, however, is dependent on the number and type of substituents it carries at the $R^1$, $R^2$ and $R^3$ positions. Because of this, the encapsulation of a cetane improving additive inside a cyclodextrin host molecule can effectively modify the solubility of the additive, since the solubility of the complex as a whole will be determined by that of the cyclodextrin molecule rather than the guest.

It has moreover been found, surprisingly, that a modified cyclodextrin (I) can enhance the activity of a cetane improving guest molecule. In cases it can modify the activity of an additive so as to render it more useful as a cetane improver. These effects can also be of benefit in the formulation of fuels which require cetane improvers.

A further potential benefit can arise because the cyclodextrin host is able to release the cetane improver guest molecule under certain conditions, for example conditions which weaken the association between host and guest or which degrade the cavity-forming macromolecular structure of the cyclodextrin, for instance by evaporation. It can therefore be possible to select, or tailor, the modified cyclodextrin (I) so as to carry—and if necessary protect—a cetane improver under certain conditions but to release it at a desired time or location where its effect is most needed. For example, a cetane improver may be of particular use within the fuel injection and combustion regions of an engine: targeting its release to those regions can therefore improve its efficacy.

A yet further advantage to the use of molecular encapsulants, as opposed to the polymeric matrices and microcapsules proposed as additive delivery vehicles in the past, is that they are much smaller and thus less likely to cause blockages in for example fuel lines and fuel filters, or the build-up of undesired deposits in fuel-consuming systems.

The use of host-guest inclusion complexes as carriers for fuel additives was proposed in 1967 in U.S. Pat. No. 3,314,884. This document mentioned cyclodextrins as potential host compounds, but did not exemplify their use. However, unmodified cyclodextrins (ie cyclodextrins of formula (I) in which $R^1$, $R^2$ and $R^3$ are all hydrogen) are crystalline materials and insoluble in organic systems, in particular in low polarity organic systems such as liquid hydrocarbons. They would not therefore be expected to be of use in typical hydrocarbon-based fuel formulations. Indeed although cyclodextrins are widely used as vehicles for active substances in foods, beverages, fragrances, cosmetics and pharmaceuticals, in these contexts they are formulated in aqueous rather than low polarity organic systems.

Documents such as U.S. Pat. Nos. 5,199,959; 5,226,925; 5,482,520 and U.S. 2001/0003231 teach the use of calixarenes as hosts for compounds which reduce nitrogen oxide levels in diesel fuels, and for compounds which improve the thermal stability of liquid oil products such as kerosenes, jet fuels and lubricating oils. Calixarenes are macrocyclic molecules which, like cyclodextrins, form cavities in which guest molecules can be captured. The chemical structure of their constituent hydrocarbon rings is, however, very different to that of the hydrophilic sugar unit from which a cyclodextrin molecule is constructed, and as a class they have potentially lower functional versatility.

The additive composition of the invention should be suitable for use in a diesel fuel formulation. It may be adapted for use in such a formulation, and/or intended for such use. Preferably it is suitable and/or adapted for such use.

In the present context, a diesel fuel formulation may be any formulation, typically in liquid form, which is suitable and/or adapted for use as a combustible fuel in a compression ignition fuel-consuming system. It may in particular be hydrocarbon-based, ie comprising a major proportion (for example 80% v/v or more, or 85 or 90 or 95% v/v or more) of hydrocarbon fuel components such as alkanes, cycloalkanes, alkenes and aromatic hydrocarbons. The hydrocarbon fuel components may be mineral-derived, or derived from a biological source, or synthetic. Such a formulation may contain one or more components in addition to its hydrocarbon fuel components, for example selected from oxygenates, biofuel components and fuel additives.

A diesel fuel formulation may in particular be an automotive diesel fuel formulation.

Other preferred features of the diesel fuel formulation may be as described below in connection with the second aspect of the invention.

In the additive composition of the invention, the cyclodextrin of formula (I) is modified so as to increase its solubility in organic (in particular hydrocarbon-based) formulations. The modified cyclodextrin (I), and the overall additive composition, are thus suitably soluble in a diesel fuel formulation in which they are adapted and/or intended to be used. Such a formulation will typically be of low polarity, although the inclusion of higher polarity components such as fatty acid methyl esters may increase the polarity of the formulation relative to its base hydrocarbons. The natures of the groups $R^1$, $R^2$ and $R^3$ should be such as to impart the desired solubility characteristics to the cyclodextrin molecule, allowing the additive composition to be tailored for use in a chosen fuel formulation.

In this way, it can be possible to modify the effective solubility of a cetane improver in a diesel fuel formulation. Once encapsulated in a cyclodextrin host molecule, a cetane improver molecule which would otherwise be relatively insoluble in the formulation can benefit from the greater solubility of its host.

In an embodiment of the invention, the modified cyclodextrin of formula (I) is an alkylated cyclodextrin. By "alkylated cyclodextrin" is meant a cyclodextrin of formula (I) in which at least one of the groups $R^1$, $R^2$ and $R^3$ is an optionally substituted (but in particular unsubstituted) alkyl group. In an embodiment, two or at least two of the groups $R^1$, $R^2$ and $R^3$ are independently selected from optionally substituted (in particular unsubstituted) alkyl groups. In an embodiment, all three of the groups $R^1$, $R^2$ and $R^3$ are independently selected from optionally substituted (in particular unsubstituted) alkyl groups.

Where an alkylated cyclodextrin is substituted with two or more alkyl groups, the two or more alkyl groups may be the same.

In an alkylated cyclodextrin, suitably any of the groups $R^1$, $R^2$ and $R^3$ which are not alkyl groups are hydrogen. Thus, the groups $R^1$, $R^2$ and $R^3$ may be independently selected from hydrogen and optionally substituted (in particular unsubstituted) alkyl. In an embodiment, $R^1$ is selected from optionally substituted (in particular unsubstituted) alkyl and $R^2$ and $R^3$ are both hydrogen. In an embodiment, $R^1$ and $R^3$ are independently selected from optionally substituted (in particular unsubstituted) alkyl and $R^2$ is hydrogen.

In general, in an alkylated cyclodextrin, the overall degree of substitution at the three positions $R^1$, $R^2$ and $R^3$ may for instance be 33% or greater, or 50% or greater, or 66% or greater. The degree of substitution at an individual position $R^1$, $R^2$ or $R^3$ may be from 0 to 100%, for example 10% or greater, or 25% or greater, or 50% or greater, or 75% or greater. In embodiments, the alkyl substituents may be randomly distributed between the positions $R^1$, $R^2$ and $R^3$.

In an alkylated cyclodextrin of formula (I), the integer n may in particular be from 6 to 8, more particularly 7.

In the context of the present disclosure, an "alkyl" group may be a straight or branched-chain alkyl group. It may contain up to 22 carbon atoms, or up to 20 or 18 or 16 or 14 or 12 carbon atoms, or in cases up to 6 or 5 or 4 or 3 carbon atoms. It may contain 1 carbon atom or more, or 2 or 3 carbon atoms or more, for example from 1 to 12 or from 1 to 10 or from 1 to 8 carbon atoms, or from 1 to 6 or from 1 to 4 or from 1 to 3 carbon atoms, or in cases from 2 to 8 or from 3 to 8 or from 4 to 8 carbon atoms. An alkyl group may for instance be selected from methyl, ethyl, propyl and butyl groups. It may be selected from methyl and butyl groups. A butyl group substituent may be an n-butyl group, or it may be a mixture of n-butyl and isobutyl groups.

In particular when the modified cyclodextrin (I) is an alkylated cyclodextrin, the alkyl group(s) may be selected from C1 to C12 alkyl groups, or from C2 to C12 or C3 to C12 alkyl groups. They may be selected from C1 to C10 alkyl groups, or from C2 to C10 or C3 to C10 or C4 to C10 alkyl groups. They may be selected from C1 to C8 alkyl groups, or from C2 to C8 alkyl groups, or from C3 to C8 or C4 to C8 alkyl groups. They may be selected from C1 to C6 alkyl groups, or from C2 to C6 alkyl groups, or from C3 to C6 or C4 to C6 alkyl groups. They may be selected from C1 to C5 alkyl groups, or from C2 to C5 alkyl groups, or from C3 to C5 alkyl groups. They may be selected from C1 to C4 alkyl groups, or from C2 to C4 alkyl groups, or from C3 to C4 alkyl groups.

In a specific embodiment, $R^1$, $R^2$ and $R^3$ are the same and are selected from C1 to C4 alkyl groups, in particular methyl.

In another specific embodiment, at least two of $R^1$, $R^2$ and $R^3$ (for example two of, such as $R^1$ and $R^3$) are selected from C1 to 12 or C1 to C10 or C1 to C8 alkyl groups, or from C2 to C10 or C2 to C8 or C2 to C6 alkyl groups, or from C2 to C10 or C2 to C8 or C2 to C6 alkyl groups. In particular, at least two of $R^1$, $R^2$ and $R^3$ (for example two of, such as $R^1$ and $R^3$) may be butyl, and the remaining group, if appropriate, may then be hydrogen. Thus, for example, the modified cyclodextrin (I) may be a heptakis(2,6-di-O-n-butyl)-cyclodextrin.

In a modified cyclodextrin of formula (I), an alkyl group may be substituted with one or more, typically one, hydroxyl groups, which may be primary, secondary or tertiary hydroxyl groups, in particular secondary. A hydroxyl-substituted alkyl group (a "hydroxyalkyl" group) may in particular be hydroxypropyl (for example 2-hydroxypropyl) or hydroxyethyl, more particularly hydroxypropyl. In an embodiment, at least one of the groups $R^1$, $R^2$ and $R^3$ is a hydroxyalkyl group. In an embodiment, $R^1$ is a hydroxyalkyl group, in particular 2-hydroxypropyl, and in this case $R^2$ and $R^3$ are suitably hydrogen.

An alkyl group may be substituted with one or more, typically one, amine groups —$NR^4R^5$, where $R^4$ and $R^5$ are each independently selected from hydrogen and optionally substituted (suitably unsubstituted) alkyl groups, in particular from hydrogen and C1 to C4 or C1 to C3 or C1 to C2 alkyl groups. An amine group—$NR^4R^5$ may in particular be —$NH_2$.

An "aryl" group is a group which contains an aromatic hydrocarbon ring, for example phenyl, benzyl, tolyl, xylyl, naphthyl or anthracyl. It may for example be a C5 to C18 aryl group, or a C6 to C18 aryl group, or a C6 to C14 or C6 to C10 or C6 to C8 aryl group. It may in particular be phenyl or benzyl, more particularly benzyl.

A "carbonyl" group is a group of the formula $R^6$—C(O)—, where $R^6$ is an optionally substituted (suitably unsubstituted) alkyl or aryl group, for example an alkyl, phenyl or benzyl group, where an alkyl group may in particular be a C1 to C4 or C1 to C3 or C1 to C2 alkyl group. A carbonyl group may in particular be acetyl or benzoyl, more particularly acetyl.

An "optionally substituted" group may be substituted with one or more, for example one or two, in particular one, substituents, which substituents may for example be selected from alkyl, more particularly C1 to C4 alkyl or C1 to C3 alkyl or C1 to C2 alkyl, for example methyl; aryl, for example phenyl; carboxylic acids and carboxylate ions, for example —$CH_2CO_2H$, —$CO_2H$ or the corresponding anions; alkoxyl, for example ethoxyl or methoxyl, in particular methoxyl; amine (for example —$NR^4R^5$) and amide groups, in particular primary amine and amide groups; and —OH. In particular, such substituents may be selected from alkyl, aryl, alkoxyl and —OH. Yet more particularly, they may be selected from alkyl groups, for example C1 to C4 or C1 to C3 or C1 to C2 alkyl groups, such as methyl.

An "optionally substituted" group may in particular be unsubstituted.

In an embodiment of the invention, the groups $R^1$, $R^2$ and $R^3$ are independently selected from hydrogen, unsubstituted alkyl (in particular unsubstituted C1 to C8 or C1 to C4 alkyl) and hydroxyalkyl (in particular C1 to C4 hydroxyalkyl, more particularly hydroxypropyl). In an embodiment, $R^1$ is selected from optionally substituted alkyl (in particular unsubstituted alkyl and hydroxyalkyl) and carbonyl, and $R^2$ and $R^3$ are both hydrogen. In an embodiment, $R^1$ is selected from optionally substituted alkyl (in particular unsubstituted alkyl and hydroxyalkyl), and $R^2$ and $R^3$ are both hydrogen.

In general, the carbon chain length of the groups $R^1$, $R^2$ and $R^3$ may be chosen to enhance solubility of the cyclodextrin (I) in a chosen diesel fuel formulation, longer chain groups typically leading to a greater hydrophobicity and hence a greater affinity for lower polarity, more hydrophobic organic systems. For use in more polar formulations such as high oxygenate content diesel fuel formulations, it may be preferred for the groups $R^1$, $R^2$ and $R^3$ to be selected from shorter chain alkyl groups, in particular methyl, and/or from alkyl groups which are substituted with polar functional groups such as hydroxyl. Longer chain alkyl groups, for example butyl, may be used to render the cyclodextrin more hydrophobic.

For use in a low polarity diesel fuel formulation, it may be preferred for at least one, suitably two or three, of the groups $R^1$, $R^2$ and $R^3$ to be a longer chain (for example C4 or greater, or C4 to C12 or C4 to C10 or C4 to C8) alkyl group, which is suitably unsubstituted. In cases such a longer chain alkyl group may be a C12 to C22 or C12 to C18 alkyl group.

In an embodiment, in particular where the additive composition is for use in a non-polar diesel fuel formulation, the groups $R^1$, $R^2$ and $R^3$ may be independently selected from hydrogen and unsubstituted alkyl (in particular C1 to C8 or C4 to C8 alkyl, for example methyl or more particularly butyl). Yet more particularly, at least two of $R^1$, $R^2$ and $R^3$ (for example $R^1$ and $R^3$) may be independently selected from unsubstituted alkyl (for example C1 to C8 or C4 to C8 alkyl, in particular methyl or butyl, more particularly butyl): the two or more alkyl groups may be the same.

In an embodiment, in particular where the additive composition is for use in a moderately polar diesel fuel formulation, for example a formulation containing up to about 10% v/v of an oxygenate such as a fatty acid methyl ester (FAME), one or two of the groups $R^1$, $R^2$ and $R^3$ (for example $R^1$ and $R^3$) may be independently selected from unsubstituted alkyl (in particular C1 to C8 or C1 to C4 alkyl, for example methyl or butyl, more particularly methyl) and the remaining group(s) may be hydrogen. Thus, for example, the modified cyclodextrin (I) may be a tri-methyl cyclodextrin or a di-O-n-butyl cyclodextrin.

In an embodiment, in particular where the additive composition is for use in a more polar diesel fuel formulation, for example a formulation containing greater than about 5 or 10% v/v of an oxygenate such as a FAME (or in cases 20 or 30 or 40 or 50% v/v or more of such an oxygenate), at least one of the groups $R^1$, $R^2$ and $R^3$ may be an alkyl group (in particular a C1 to C4 alkyl group) substituted with a polar group such as hydroxyl: in this case, suitably at least $R^1$ is a hydroxyalkyl group.

In an embodiment, the modified cyclodextrin (I) is an alkylated cyclodextrin in which the alkyl group(s) are selected from unsubstituted C1 to C12 or C1 to C8 or C2 to C8 alkyl groups.

A particularly preferred alkylated cyclodextrin is substituted with two butyl groups (for example n-butyl groups, or a mixture of n-butyl and isobutyl groups) on each monomer residue: such a cyclodextrin is suitably a β-cyclodextrin. These cyclodextrins have been found to have good solubility in a range of diesel fuels, and are expected to exhibit a good balance (HLB balance) of hydrophilic and hydrophobic characteristics.

In the modified cyclodextrin (I), the integer n may in particular be from 4 to 10, or from 5 to 9, or more particularly from 6 to 8. When n=6 the cyclodextrin is an α-cyclodextrin, which forms a frustoconical structure having an external diameter of 1.4 nm and an internal cavity diameter of 0.6 nm. When n=7 it is a β-cyclodextrin, which forms a frustoconical structure having an external diameter of 1.5 nm and an internal diameter of 0.8 nm. When n=8 it is a γ-cyclodextrin, in which the frustocone has an external diameter of 1.7 nm and an internal diameter of 1.0 nm. Thus, the value of n affects the size of the cavity in which a guest molecule can be encapsulated. It may therefore be chosen to yield a cavity of a size suitable to accommodate one or more molecules of (suitably one molecule of) a chosen cetane improver.

In an embodiment of the invention, the modified cyclodextrin (I) is a β-cyclodextrin (ie n=7).

In the context of the present disclosure, a cetane improver is a substance which is capable of increasing the cetane number of a fuel formulation in which it is present, either uncomplexed and/or when in the form of an inclusion complex within a host molecule of the modified cyclodextrin (I). It may be a substance which is capable of increasing the cetane number of a fuel formulation in which it is present, but not in the form of an inclusion complex with the modified cyclodextrin (I). In general a cetane improver may be capable of improving the ignition properties of a diesel fuel formulation when the formulation is used in an engine or other fuel-consuming system.

The cetane improver should be suitable and/or adapted for use as a diesel fuel additive.

In an embodiment, the cetane improver is a polar species.

A cetane improver may also be known as a cetane number improver or an ignition improver. Many such additives are known and commercially available; they typically function by increasing the concentration of free radicals when a fuel begins to react in a combustion chamber of a fuel-consuming system. Examples include organic nitrates and nitrites, in particular (cyclo)alkyl nitrates such as isopropyl nitrate, 2-ethylhexyl nitrate (2-EHN) and cyclohexyl nitrate, and ethyl nitrates such as methoxyethyl nitrate; and organic (hydro)peroxides such as di-tert-butyl peroxide. Cetane improving diesel fuel additives are commercially available for instance as HITEC™ 4103 (ex Afton Chemical) and as CI-0801 and CI-0806 (ex Innospec Inc).

In an embodiment, the cetane improver is selected from organic nitrates and nitrites, in particular (cyclo)alkyl nitrates; organic (hydro)peroxides; and mixtures thereof. In an embodiment it is selected from 2-EHN, di-tert-butyl peroxide, and mixtures thereof.

In the context of the present disclosure, a cetane improver may be a substance which is not usually capable of increasing the cetane number of a fuel formulation, but becomes capable of doing so when encapsulated in a modified cyclodextrin (I). In particular, such a substance may be an octane booster.

Thus, in general terms, the "cetane improver" used in the present disclosure may be any combustion improver which is suitable and/or adapted for use as an additive in a diesel fuel formulation and which is capable, when present as a guest molecule in an inclusion complex with a modified cyclodextrin (I), of increasing the cetane number of a fuel formulation to which it is added. A combustion improver will typically be selected from cetane improvers of the type described above, octane boosters, and mixtures thereof.

An octane booster is a substance which is capable of increasing the octane number of a fuel formulation in which it is present, either uncomplexed and/or when in the form of an inclusion complex within a host molecule of the modified cyclodextrin (I). In general an octane improver may be capable of improving the ignition properties of a gasoline fuel formulation when the formulation is used in an engine or other fuel-consuming system.

Such an octane booster is ideally suitable and/or adapted for use as a gasoline fuel additive.

Many such additives are known and commercially available. Aromatic amines for example, in particular anilines, are known for use as octane boosters in gasoline fuels. WO 2008/073118, WO 2008/076759, WO 2010/001341 and RU 2235117 describe the use of N-alkyl anilines such as N-methyl aniline (NMA) for this purpose.

Ethers such as alkyl t-butyl ethers (for example methyl t-butyl ether (MTBE) and ethyl t-butyl ether (ETBE)) have also been included as octane boosters in gasoline fuels. U.S. Pat. Nos. 6,858,048; 5,470,358; U.S. 2006/0225340; EP 0 948 584; WO 02/22766 and U.S. 2008/0168706 disclose aviation gasoline formulations containing ether, ester and alcohol octane boosters.

Also known as octane boosters are species which include aromatic moieties such as phenyl or cyclopentadienyl rings, in particular phenyl rings. Such octane boosters may be entirely organic (for example toluene), or they may include metallic components such as in the aromatic octane-boosting metal complexes methylcyclopentadienyl manganese tricarbonyl (MMT), ferrocene (which comprises two cyclopentadienyl rings bound to a central $Fe^{2+}$ ion) and substituted ferrocenes such as alkyl (eg decamethyl) ferrocene. An aromatic octane booster may therefore be selected, for example, from aromatic amine octane boosters, alkyl-substituted benzenes (in particular toluene), alkyl-substituted phenols, quinoline derivatives, metal-containing aromatic octane boosters, and mixtures thereof. It may be selected from phenol derivatives and mixtures thereof. It may for example comprise an alkyl-substituted phenol such as cresol (in particular m-cresol), 4-ethylphenol or 2,4,6-trimethylphenol. An alkyl-substituted phenol may be substituted with up to 5, suitably up to 4, more suitably up to 3, alkyl groups, which may in particular be C1 to C4 alkyl groups and more particularly C1 to C2 alkyl groups. An aromatic octane booster may be selected from quinoline derivatives and mixtures thereof: it may for example comprise 1,2,3,4-tetrahydroquinoline.

Another known octane booster is iso-octane.

An aromatic amine octane booster may in particular be a species which includes an amine-substituted phenyl ring. An amine-substituted phenyl ring may be further substituted, at the nitrogen atom of the amine group and/or at one or more carbon atoms on the phenyl ring. Thus, an aromatic octane booster may be an aniline (ie aniline itself or a substituted aniline).

A substituted aniline may be substituted at a ring carbon atom and/or at the nitrogen atom, and may for example be mono- or di-substituted, in particular mono-substituted. Suitable substituents may be selected from C1 to C4 alkyl groups and phenyl, in particular methyl, ethyl and phenyl, more particularly methyl and ethyl.

Substituted anilines may therefore include alkyl-substituted anilines, in which the phenyl ring is substituted with one or more, in particular one, alkyl group (as in, for instance, 4-ethyl aniline or a toluidine such as m-toluidine); halo-substituted anilines, in which the phenyl ring is substituted with one or more, in particular one, halo group selected for instance from fluoro and chloro groups, as in 4-fluoro aniline; alkoxyl-substituted anilines, in which the phenyl ring is substituted with one or more, in particular one, alkoxyl group (as in, for instance, an anisidine such as m-anisidine); amine-substituted anilines, in which the phenyl ring is substituted with one or more, in particular one, amine group of the formula —$NR^1R^2$ in which $R^1$ and $R^2$ are independently selected from hydrogen and alkyl (for instance N,N-diethyl-p-phenylenediamine); and N-substituted anilines, in which the nitrogen atom of the amine group is substituted with one or more, in particular one, group selected from alkyl and phenyl groups (for instance N-alkyl anilines such as N-methyl aniline, and N-phenyl anilines such as diphenylamine).

In an embodiment, an aromatic octane booster is selected from aniline; m-toluidine; p-toluidine; 4-ethyl aniline; N-methyl aniline; diphenylamine; 4-fluoroaniline; m-anisidine; N,N-diethyl-p-phenylenediamine; p-cresol; m-cresol; MMT; ferrocene; 1,2,3,4-tetrahydroquinoline; 4-ethylphenol; 2,4,6-trimethylphenol; and mixtures thereof. In an embodiment, it is selected from aniline; m-toluidine; 4-ethyl aniline; diphenylamine; 4-ethylphenol; 2,4,6-trimethylphenol; MMT; ferrocene; and mixtures thereof.

It is likely to be preferred for an aromatic amine octane booster not to be a pyrrole.

An octane booster may be selected from species which include aromatic moieties, as described above, in particular aromatic amines and more particularly anilines; ethers, in particular dialkyl ethers and more particularly alkyl t-butyl ethers; and mixtures thereof. In an embodiment it is selected from aromatic amines, in particular anilines, and mixtures thereof.

An additive composition according to the invention may comprise a mixture of two or more different cetane improvers. Not all of these need be present as guest molecules within modified cyclodextrin host molecules. Thus, the composition may comprise one or more additional cetane improvers which are not encapsulated in modified cyclodextrins of formula (I).

The additive composition of the invention may comprise a solvent carrier, or mixture thereof, for the cetane improver and the modified cyclodextrin (I). Suitable such solvents are well known and commercially available. Commonly used additive solvents include hydrocarbon solvents such as alkanes, alkenes and aromatic hydrocarbons; mixtures of hydrocarbons such as in distillate fractions; and more polar solvents such as alcohols and ethers. The nature of the solvent or solvent mixture used in the additive composition (in particular its polarity) may be chosen to suit the natures and polarities of the cetane improver and the modified cyclodextrin, as well as of a diesel fuel formulation in which the additive composition is to be used, so as to optimise the stability and efficacy of the composition during use.

In an embodiment, however, the additive composition may be in solid form.

The concentration, in the additive composition, of the inclusion complex formed between the cetane improver and the modified cyclodextrin (I) may for example be 10 ppmw (parts per million by weight) or greater, for example 50 or 100 ppmw or greater. It may for example be up to 10,000 ppmw, or up to 5,000 ppmw, such as from 10 to 10,000 ppmw or from 100 to 5,000 ppmw. In an embodiment, the additive composition may consist essentially of (for example it may contain at least 98 or 99% w/w of) the inclusion complex, in particular when the composition is in solid form.

The molar ratio of the cetane improver to the modified cyclodextrin (I), in the additive composition, may for example be 1:50 or greater, or 1:25 or greater, or 1:20 or greater. This ratio may for example be up to 5:1, or up to 2:1 or 1:1, or up to 1:2 or 1:5 or 1:10, such as from 1:50 to 5:1, or from 1:50 to 2:1, or from 1:50 to 1:1, or in case from 1:50 to 1:2 or from 1:20 to 1:10, for example about 1:10.

This ratio may depend on the natures of the cetane improver and the modified cyclodextrin (I): it may be possible to encapsulate one or two molecules of a smaller cetane improver within a single cyclodextrin host molecule, for example, whilst in other cases two cyclodextrin molecules may be able to fit around a single guest molecule. A polymeric cetane improver may be capable of associating with more than one cyclodextrin molecule, each complexing with a discrete part of the polymer molecule.

In embodiments of the invention, a molar excess of the modified cyclodextrin (I) or of the cetane improver may be used to achieve a desired technical effect in a diesel fuel formulation to which the composition is added. For example, an excess of the cetane improver will provide a quantity of unencapsulated cetane improver (which is immediately available but may therefore be more readily lost or degraded over time), together with a quantity of encapsulated cetane improver (which may be released later at a desired location or time, in response to an appropriate trigger, after the unencapsulated cetane improver has been depleted). This can be used to prolong the effective lifetime of the cetane improver prior to and/or during its use in a diesel fuel formulation.

An additive composition according to the invention may comprise one or more additional active substances, as well as the cetane improver. In this context, an "active substance" is a substance which is active as, and suitable for use as, a diesel fuel additive. Such a substance is capable of performing a technical function when incorporated in a diesel fuel formulation: it will typically be capable of modifying a property of, and/or the performance of, the formulation. In an embodiment, it is a substance which is suitable and/or adapted for use as an automotive diesel fuel additive.

An additional active substance may for example be selected from antioxidants, corrosion inhibitors, detergents and dispersant additives, metal deactivators, valve-seat recession protectant compounds, viscosity modifiers, dyes and other markers, friction modifiers, lubricity additives, additional cetane improvers, antistatic additives, antifoaming agents, cold flow additives, and combinations thereof. It may in particular be selected from antioxidants; combustion improvers (for example additional cetane improvers); detergents; lubricity additives; cold flow additives; and combinations thereof. It may be selected from antioxidants; combustion improvers (for example additional cetane improvers); detergents; and mixtures thereof, or from combustion improvers (in particular additional cetane improvers); detergents; and mixtures thereof.

In an embodiment, an additional active substance is a polar species.

Not all such additional active substances need be present as guest molecules within modified cyclodextrin host molecules. Thus, the additive composition may comprise one or more additional active substances which are not encapsulated in modified cyclodextrins of formula (I).

The composition may comprise a mixture of two or more different modified cyclodextrins of formula (I). Not all of these need be complexed with a cetane improver or other active substance.

An additive composition according to the invention may be prepared by mixing together the cetane improver and the modified cyclodextrin (I), suitably with a solvent carrier or mixture thereof, and optionally with one or more additional diesel fuel additives or active substances. Techniques for preparing a cyclodextrin inclusion complex, containing a guest molecule, are known to those skilled in the art: suitable examples include kneading, heating, co-precipitation, freeze-drying or lyophilisation, spray-drying, gas-liquid methods, supercritical fluid-based methods, and combinations thereof (see for example Marques, "A review on cyclodextrin encapsulation of essential oils and volatiles", *Flavour Fragr J,* 2010, 25: 313-326, in particular pages 321-322; and *Chemical Reviews* 98, 2035-2044). By way of example, the cyclodextrin (I) and the cetane improver may be stirred together in an appropriate solvent, with heating if necessary, in order to generate the desired host-guest complex, followed by removal of the solvent by suitable means such as filtration or spray drying. Known techniques may be used to verify complex formation, for instance nuclear magnetic resonance spectroscopy, visible or ultraviolet spectroscopy, fluorescence spectroscopy, infrared spectroscopy, differential scanning calorimetry or other thermal methods, X-ray diffraction, chromatography, mass spectrometry, optical methods, vacuum methods, or with reference to phase solubility changes (again, see Marques, as referenced above, pages 322-324).

The cetane improver and the modified cyclodextrin (I) may each be used in a suitable respective solvent or other carrier. Thus, the additive composition of the invention may be prepared by combining a first premix containing the cetane improver, optionally with one or more carriers, and a second premix containing the modified cyclodextrin (I), optionally with one or more carriers. A premix comprising a modified cyclodextrin of formula (I), in particular together with one or more carriers which are suitable for use in a diesel fuel formulation, may therefore constitute an essential element for the carrying out of embodiments provided herein.

The carriers in such a premix may in particular be liquid carriers. They may conveniently be of low polarity, and/or hydrophobic, and/or non-aqueous, to render them suitable for use in a diesel fuel formulation. The premix may for example be combined with a cetane improver-containing additive package in order to form a composition according to the first aspect of the invention.

A modified cyclodextrin of formula (I) may be obtained from an unmodified cyclodextrin by standard chemical techniques, as would be well known to the synthetic chemist. Unmodified cyclodextrins are widely available commercially; they are typically produced from starch by enzymatic conversion. Thus, a cyclodextrin (I) may be derived from a biological source, which can be advantageous as there is increasing demand for diesel fuel formulations to include higher concentrations of biologically-derived components.

The cetane improver and the modified cyclodextrin (I), and in particular the value for the integer n and the natures of the groups $R^1$, $R^2$ and $R^3$, are suitably chosen such that they naturally associate with one another, to form the desired host-guest inclusion complex, under the desired conditions of preparation, storage, transport and/or use of the composition, in particular during its use in a diesel fuel formulation.

In an embodiment of the invention, the modified cyclodextrin (I) may be tailored for use under specific conditions and/or with a specific cetane improver. More particularly, it may be tailored so as to release the cetane improver guest molecule under specific conditions. In this way, the composition of the invention may be used to control—including to target—delivery of the cetane improver in a diesel fuel formulation.

By way of example, the cetane improver may be wholly or partially released from the cyclodextrin inclusion complex when the composition is exposed to a temperature within a specific range, for example a temperature range to which a diesel fuel formulation is exposed during a critical period of use. In this way, the cetane improver can be protected and stabilised by the cyclodextrin—or in the case of a cetane improver which presents a health or safety hazard, can be rendered safer by its encapsulation—until the point when its chemical effect is most needed, for example in the combustion region of a fuel-consuming system. Instead or in addition, the cetane improver may be wholly or partially released from the inclusion complex when the composition is exposed to a pressure within a specific range, or to a shear force within a specific range.

The cetane improver and the modified cyclodextrin (I) may be chosen such that during use, the cetane improver is released at a desired rate from the cyclodextrin inclusion complex, thus potentially prolonging the efficacy of the cetane improver in the additive composition or in a diesel fuel formulation.

In an embodiment of the invention, the cetane improver and the modified cyclodextrin (I) are such that the cetane improver is released from the cyclodextrin inclusion complex when the additive composition is subjected to a temperature above or below (in particular above) a predetermined value, for example a temperature within the operating range of an engine or other fuel-consuming system in which the additive composition is, or is intended to be, used. The cetane improver may for example be released when the composition is exposed to a temperature of 50° C. or greater, or of 60° C. or greater, or of 100 or 150° C. or greater, or of 200 or 220° C. or greater.

Cyclodextrins are thermally degradable. The rate and onset of their thermal degradation varies depending on their substituents and the value of n in the formula (I) above. By way of example, trimethyl-substituted β-cyclodextrin has been found to be generally stable at 50-150° C. (no significant degradation over 200 minutes); to degrade at approximately 0.01 mg/min at 200° C.; and at 250° C. to exhibit a faster degradation rate of approximately 1 mg/min. The molecule would therefore be suitable as a host for a cetane improving fuel additive: the additive would remain encapsulated under storage conditions (fuel tank temperatures, for example, are typically ~50° C.); be slowly released under warmer conditions (for example the fuel line of a common rail diesel system is likely to be at ~150° C.); be more quickly released under hot conditions (eg post-injection, before combustion); and be almost immediately released under very hot conditions, at the point of combustion.

In an embodiment, the cetane improver and the modified cyclodextrin (I) are such that the cetane improver is released from the cyclodextrin inclusion complex when the composition is subjected to a pressure above a predetermined value, for example a pressure within the operating range of an engine or other fuel-consuming system in which the additive composition is, or is intended to be, used. The cetane improver may for example be released when the composition is exposed to a pressure of greater than 1 atmosphere, or of 100 or 200 atmospheres or greater, or of 500 or 1,000 or 1,500 or 2,000 atmospheres or greater, for example of up to 2,200 atmospheres.

The cetane improver and the modified cyclodextrin (I) may be such that the cetane improver is released when the composition is subjected to a pressure below a predetermined value, for example a pressure below 1 atmosphere.

In an embodiment, the cetane improver and the modified cyclodextrin (I) are such that the cetane improver is released from the cyclodextrin inclusion complex when the additive composition is exposed to another species, for example a species which can compete with the cetane improver to enter the cyclodextrin cavity.

Thus, the nature of the cyclodextrin (I), and in particular of its modifying groups $R^1$, $R^2$ and $R^3$, may be tailored to suit not only the environment in which, and the cetane improver with which, it is intended to be used, but also the conditions under which it associates with and dissociates from the cetane improver, and/or under which it otherwise releases a guest molecule, for instance by itself degrading at the molecular or macromolecular level.

According to a second aspect, there is provided a diesel fuel formulation comprising an additive composition according to the first aspect.

In an embodiment, the diesel fuel formulation is an automotive diesel fuel formulation. In further embodiments, it may be an industrial gas oil formulation, a heating oil formulation or more particularly a marine diesel fuel formulation. In an embodiment, the formulation is a diesel fuel formulation which contains an oxygenate or biodiesel component such as a FAME or a hydrogenated vegetable oil, in particular a FAME. The concentrations of such oxygenates and biodiesel components may for instance be as described below.

Apart from the additive composition of the invention, such a formulation may be conventional in terms of its constituents and their relative concentrations. It may for example comprise a diesel base fuel.

A diesel base fuel may be any fuel component, or mixture thereof, which is suitable and/or adapted for combustion within a compression ignition (diesel) engine. It will typically be a liquid hydrocarbon middle distillate fuel, more typically a gas oil. It may be petroleum-derived. It may be or contain a kerosene fuel component. It may be or contain a synthetic fuel component, for instance a product of a Fischer-Tropsch condensation process. It may be or contain a fuel component derived from a biological source, for example a hydrogenated bio-derived oil (in particular a hydrogenated vegetable oil, HVO) or mixture thereof. It may be or contain an oxygenate such as a fatty acid alkyl ester, in particular a fatty acid methyl ester (FAME) such as rapeseed methyl ester (RME) or palm oil methyl ester (POME).

A diesel base fuel will typically boil in the range from 150 or 180 to 370° C. (ASTM D86 or EN ISO 3405). It will suitably have a measured cetane number (ASTM D613) of from 40 to 70 or from 40 to 65 or from 51 to 65 or 70.

A diesel fuel formulation according to the second aspect of the invention may comprise a diesel base fuel at a concentration of 50% v/v or greater, or 60 or 70 or 80% v/v or greater, or 85 or 90 or 95 or 98% v/v or greater. The base fuel concentration may be up to 99.99% v/v, or up to 99.95% v/v, or up to 99.9 or 99.5% v/v. It may be up to 99% v/v, for example up to 98 or 95 or 90% v/v, or in cases up to 85 or 80% v/v.

Where the diesel fuel formulation comprises an oxygenate or biodiesel component such as a FAME, its concentration may be 1% v/v or greater, or 2 or 5% v/v or greater, based on the overall formulation, or in cases 7 or 10 or 20 or 30% v/v or greater. The FAME concentration may be up to 100% v/v (in other words, the diesel fuel formulation may consist of a FAME or mixture of FAMEs, optionally with one or more diesel fuel additives), or up to 99 or 98 or 95% v/v, or up to 90 or 80 or 70 or 60 or 50% v/v, or in cases up to 40 or 30 or 20 or 10% v/v, for example from 1 to 40% v/v.

In an embodiment of the invention, however, it may be preferred for the diesel fuel formulation to contain no, or only a low concentration of (for example 5% v/v or less, or 2% v/v or less, or 1 or 0.5% v/v or less of), oxygenate components, or at least of FAMEs such as POME.

A diesel fuel formulation according to the invention will suitably comply with applicable current standard diesel fuel specification(s) such as for example EN 590 (for Europe) or ASTM D975 (for the USA). By way of example, the overall formulation may have a density from 820 to 845 kg/m$^3$ at 15° C. (ASTM D4052 or EN ISO 3675); a T95 boiling point (ASTM D86 or EN ISO 3405) of 360° C. or less; a measured cetane number (ASTM D613) of 40 or greater, ideally of 51 or greater; a kinematic viscosity at 40° C. (VK40) (ASTM D445 or EN ISO 3104) from 2 to 4.5 centistokes (mm$^2$/s); a flash point (ASTM D93 or EN ISO 2719) of 55° C. or greater; a sulphur content (ASTM D2622 or EN ISO 20846) of 50 mg/kg or less; a cloud point (IP 219) of less than −10° C.; and/or a polycyclic aromatic hydrocarbons (PAH) content (EN 12916) of less than 11% w/w.

Relevant specifications may however differ from country to country, from season to season and from year to year, and may depend on the intended use of the formulation. Moreover a diesel fuel formulation according to the invention may contain individual fuel components with properties outside of these ranges, since the properties of an overall blend may differ, often significantly, from those of its individual constituents.

A diesel fuel formulation according to the second aspect of the invention may comprise, in addition to the additive composition of the first aspect, one or more fuel or refinery additives. Many such additives are known and commercially available. They may be present in a base fuel, or may be added to the formulation at any point during its preparation. Non-limiting examples of suitable types of fuel additives that can be included in a diesel base fuel or diesel fuel formulation include cetane improvers, antistatic additives, lubricity additives, cold flow additives, and combinations thereof, as well as solvents, diluents and carriers therefor. Such additives may be included in the fuel formulation at a concentration of up to 4,000 ppmw, or up to 3,000 or 2,000 or 1,000 or 500 or 300 ppmw, for example from 50 to 4,000 ppmw or from 50 to 1,500 ppmw or from 50 to 1,000 ppmw or from 50 to 500 ppmw or from 50 to 300 ppmw.

A diesel fuel formulation according to the invention should be suitable and/or adapted for use in a compression ignition (diesel) internal combustion engine. It may in particular be suitable and/or adapted for use as an automotive diesel fuel. In further embodiments it may be suitable and/or adapted for use as an industrial gas oil, or as a heating oil, or as a marine diesel fuel.

In accordance with the second aspect of the invention, the concentration of the additive composition in the diesel fuel formulation may for example be 50 ppmw or greater, or 100 or 250 or 500 ppmw or greater. Its concentration may for example be up to 10,000 ppmw, or up to 5,000 or 4,000 or 3,000 or 2,000 or 1,500 ppmw, such as from 500 to 1,500 ppmw. These concentrations relate to the concentration of the cetane improver-cyclodextrin inclusion complex in the fuel formulation, irrespective of any solvent carriers or other species which are present, with the inclusion complex, in the additive composition.

The concentration of the additive composition may be chosen such that the concentration of the cetane improver in the overall fuel formulation is for example 5 ppmw or greater, or 10 ppmw or greater, or 25 or 50 ppmw or greater. This concentration may for example be up to 1,000 ppmw, or up to 500 ppmw, or up to 300 or 200 or 150 ppmw, such as from 50 to 150 ppmw.

In a diesel fuel formulation according to the second aspect of the invention, preferred features of the additive composition (for example the natures and concentrations of the modified cyclodextrin (I) and the cetane improver) may be as described above in connection with the first aspect of the invention. In particular, the modified cyclodextrin (I) may be an alkylated cyclodextrin of the type defined above.

According to a third aspect, the present disclosure provides a method for preparing a diesel fuel formulation, the method comprising mixing together an additive composition according to the first aspect, and one or more diesel fuel components (for example diesel base fuels), optionally with one or more additional diesel fuel additives. Preferred features of the additive composition, and of the fuel component(s) and additive(s) with which it is mixed, may be as described above in connection with the first and second aspects of the invention.

The additive composition may be mixed with the other components of the diesel fuel formulation at any suitable time prior to use of the formulation, for example at the refinery or at a distribution or dispensing point downstream of the refinery, in particular at a distribution point within a refinery or fuel depot. Because the cyclodextrin host molecule can help to stabilise the encapsulated cetane improver, and to protect it from external influences such as heat, light, oxygen and other potential reactants, the invention can allow greater flexibility as to when the additive composition can be incorporated into the fuel formulation, with respect to the timings of its storage, transportation and use.

In an embodiment, the method of the third aspect of the invention involves preparing the additive composition, for example using a premix as described above, prior to mixing it with the one or more diesel fuel components. In an embodiment, the method of the third aspect involves mixing such a premix with one or more diesel fuel components. The resultant diesel fuel formulation, comprising the modified cyclodextrin-containing premix, may constitute an essential element for carrying out the second or the third aspect of the invention.

In an embodiment, the modified cyclodextrin (I) may be mixed with the one or more diesel fuel components separately from the cetane improver. It may for example be added to a mixture of diesel fuel components which already contains the cetane improver; or it may be added to a mixture of diesel fuel components prior to addition of the cetane improver.

In accordance with a fourth aspect of the invention, there is provided a method of operating a diesel fuel-consuming system, and/or apparatus (for example a vehicle, or a heating appliance) which is driven by such a system, the method comprising introducing into the system an additive composition according to the first aspect of the invention, or a diesel fuel formulation according to the second aspect. This method may for example comprise introducing the additive composition or the formulation into a combustion chamber of a diesel fuel-consuming system. The system may for example be an internal combustion engine, in particular a compression-ignition engine.

A fifth aspect of the invention provides the use of a modified cyclodextrin of formula (I) above as a vehicle for a cetane improver in an additive composition or in a diesel fuel formulation.

As described above, encapsulation of a cetane improver in a modified cyclodextrin (I) can have a number of beneficial effects within a diesel fuel formulation. Firstly, it can help protect the cetane improver from external influences such as heat, light, oxygen and other species within the formulation with which the cetane improver might otherwise interact. Thus, it can reduce the extent to which the cetane improver can become involved in undesirable chemical processes. Secondly, the cyclodextrin can help lower the volatility of the encapsulated cetane improver. In these and potentially other ways, it can improve the stability of the cetane improver, as well as of other species in the formulation which might be compromised by interaction with the cetane improver.

In cases, the cyclodextrin can aid solubilisation of the cetane improver in the diesel fuel formulation, due to the inherent solubility of the cyclodextrin itself, the host molecule effectively imparting its own solubility to the encapsulated guest molecule.

Such effects can effectively increase the activity of the cetane improver, for example by increasing its availability in a desired active form, and/or by prolonging its lifetime so that more of it is available at a given time during its use. Thus, the invention can make possible, as described below in connection with the eighth aspect of the invention, the use of a lower cetane improver concentration in a diesel fuel formulation.

In cases, it has been found that encapsulation in a modified cyclodextrin (I) can modify the nature of the effect which an active substance has on the properties and/or performance of a diesel fuel formulation, whether by the above described mechanisms or through some other, less well understood, interactions between the active substance and the host molecule. This can make it possible to use as a cetane improver a substance which would not otherwise be active as a cetane improver, or the cetane improving activity of which would otherwise be below a desired minimum. It can also make possible the use of lower concentrations of other active substances in diesel fuel formulations.

Accordingly, a sixth aspect of the invention provides the use of a modified cyclodextrin of formula (I) above in an additive composition or in a diesel fuel formulation, in combination with a cetane improver, for one or more of the following purposes:

i. modifying (in particular increasing) the solubility of the cetane improver in the composition or formulation;

ii. modifying (in particular increasing, or changing the nature of) the activity of the cetane improver in the composition or formulation;

iii. modifying (in particular increasing) the stability of the cetane improver in the composition or formulation;

iv. modifying (in particular reducing) the volatility of the cetane improver in the composition or formulation; and v. protecting the cetane improver, at least partially, from an external influence to which it may be exposed in the composition or formulation, for example heat, light, oxygen, or another species which is present in the composition or formulation.

In the context of this and other aspects of the invention, the term "cetane improver" also embraces an active substance which, in the absence of the modified cyclodextrin (I), would not be active as a cetane improver in a diesel fuel formulation, or the cetane improving activity of which, in a diesel fuel formulation, would be below a desired minimum.

In an embodiment of this sixth aspect of the invention, the modified cyclodextrin (I) is used for at least purpose (i), or for at least purposes (i) and (ii). In an embodiment, it is used for at least purpose (iii), or for at least purposes (iii) and (iv), or for at least purposes (iii) and (v), or for at least purposes (iii) and (iv) and (v). In an embodiment, it is used for at least purpose (v), or for at least purpose (iv).

It has also been found that a modified cyclodextrin (I) can be used to target, or otherwise control, delivery of a cetane improver which it encapsulates as a guest molecule. The cetane improver is released from the cyclodextrin host molecule only under certain conditions, for example conditions which cause dissociation of the host-guest complex, replacement of the cetane improver by another, competitor guest molecule, or degradation of the cyclodextrin host molecule or its macrocyclic structure (for example by evaporation or chemical degradation). Outside of the release conditions, the cyclodextrin can retain the cetane improver and protect it from external influences. Under the release conditions, the cetane improver can leave the cyclodextrin cavity and be available for reaction elsewhere. Thus, as described above, delivery of the cetane improver can be targeted to a specific set of conditions, such as a specific temperature or pressure range, or a specific applied force such as a shear force, or the introduction of another species such as a competitor guest molecule. It is possible to tailor the modified cyclodextrin (I) so as to achieve, with a chosen cetane improver, an inclusion complex which dissociates under a desired condition or set of conditions. This aspect of the invention may be of value in targeting delivery of a cetane improver to a region within a diesel fuel-consuming system, and/or to a period during use of a diesel fuel formulation, at which the cetane improver is likely to be of most use, for example within a fuel injection system or a combustion chamber. Instead or in addition, the invention may be used to target delivery of a cetane improver to a specific environment, for example a specific climate or a specific set of operating conditions within a diesel fuel-consuming system. Prior to delivery, for instance during storage and transportation, the cetane improver can be protected from potentially damaging external influences.

Thus, a seventh aspect of the invention provides the use of a modified cyclodextrin of formula (I) in an additive composition or in a diesel fuel formulation, in combination with a cetane improver, for the purpose of controlling delivery of the cetane improver within or from the composition or formulation.

In the context of this seventh aspect of the invention, "controlling" delivery of the cetane improver may involve modifying the time, location and/or rate of delivery of the cetane improver. It may involve modifying the rate at which the cetane improver is delivered into or from the additive composition or the diesel fuel formulation, for instance so as to provide sustained release over a period of time.

Controlling delivery of the cetane improver may involve targeting its delivery to a specific time or location or condition (for instance of temperature, pressure and/or shear). It may involve modifying the rate of delivery of the cetane improver; modifying the time or location at which, or the conditions under which, it is delivered; modifying the amount or proportion of it which reaches a target location, or the amount or proportion which reaches a target location within a specific time period; and/or targeting the delivery more accurately to a specific time or location. It may involve modifying (in particular enhancing) the efficacy or the perceived efficacy of the cetane improver at a target time or location, which may involve modifying (especially increasing) the speed and/or magnitude and/or duration and/or locus of the effect (in particular the cetane-improving effect) which the cetane improver has on a diesel fuel formulation at a target time or location, or increasing control over the speed, magnitude, timing, duration or locus of the effect. The invention may be used to achieve any degree of modification of such parameters.

In the present context, references to the "delivery" of a cetane improver are to making it available in a form in which it can modify the properties and/or performance of a diesel fuel formulation in which it is present. Typically, "delivery" will involve release of the cetane improver from the cyclodextrin inclusion complex.

In an embodiment, the modified cyclodextrin (I) is used to target delivery of the cetane improver to a specific location within a diesel fuel-consuming system, in particular to a fuel injection or fuel combustion region. It may be used to target delivery of the cetane improver to a specific time point, in particular a fuel injection or fuel combustion event within a diesel fuel-consuming system. It may be used to prevent or inhibit release of the cetane improver at a specific location or during a specific time period, for example during storage and/or transportation: this may be of use if the cetane improver carries health or safety risks.

For example, in a modern diesel engine with common rail technology, fuel from the tank is subjected to high temperatures and pressures before it reaches the fuel injector. Only some of the thus-exposed fuel is injected and the remainder is returned to the fuel tank where, having been subjected to temperature and/or pressure changes, it may be more susceptible to degradation. Embodiments provided herein may be used to target delivery of a cetane improver to a fuel combustion region, whilst protecting it from temperature or pressure changes upstream of the combustion region and from the resultant degradation risks.

The modified cyclodextrin (I) may be used to target release of the cetane improver to coincide with the presence of another species in a fuel-consuming system.

Use of a modified cyclodextrin (I) in accordance with the seventh aspect of the invention may involve introducing the additive composition, or the diesel fuel formulation, into a diesel fuel-consuming system (for example an engine), and subsequently subjecting the composition or formulation, within the system, to a condition which induces at least partial release of the cetane improver from an inclusion complex which it forms with the cyclodextrin. The condition may for example be a temperature or pressure within a predetermined range, or a shear force within a predetermined range, or the presence of another species which can induce cetane improver release.

Thus, the seventh aspect of the invention may comprise, or form part of, a method for delivering a cetane improver to a diesel fuel-consuming system, which method comprises the above described introduction and release-inducing steps.

The sixth and seventh aspects of the invention may be used to achieve any degree of modification of relevant parameters such as cetane improver solubility, stability, activity or delivery rate.

Because the invention may be used to improve the activity, availability, solubility or stability of the cetane improver, or to target its activity or availability, it can in turn make possible the use of a lower concentration of the cetane improver, without detriment to the overall effect of the cetane improver on a diesel fuel formulation to which it is added. Instead or in addition, the invention can make possible the use of lower concentrations of other additives which might otherwise be necessary in order to achieve a desired effect on the diesel fuel formulation. This can in turn reduce the cost and complexity of preparing the formulation, and/or can provide greater versatility in diesel fuel formulation practices.

Thus, according to an eighth aspect, the invention provides the use of a modified cyclodextrin of formula (I) above in an additive composition or in a diesel fuel formulation, in combination with a cetane improver, for the purpose of reducing the concentration of an additive present in the composition or formulation. In an embodiment, the modified cyclodextrin (I) is used for the purpose of reducing the concentration of the cetane improver. In an embodiment, it is used for the purpose of reducing the concentration of another diesel fuel additive, for example another cetane improving additive.

In the context of the eighth aspect of the invention, the term "reducing" embraces any degree of reduction, including reduction to zero. The reduction may for instance be 10% or more of the original concentration of the relevant additive, or 25 or 50 or 75 or 90% or more. The reduction may be as compared to the concentration of the additive which would otherwise have been incorporated into the composition or formulation in order to achieve the properties and performance required and/or desired of it in the context of its intended use. This may for instance be the concentration of the additive which was present in the composition or formulation prior to the realisation that a modified cyclodextrin (I) could be used in the way provided by the present disclosure, and/or which was present in an otherwise analogous additive composition or fuel formulation which was intended (eg marketed) for use in an analogous context, prior to adding a modified cyclodextrin (I) to it in accordance with the invention.

The reduction in concentration of the additive may be as compared to the concentration of the additive which would be predicted to be necessary to achieve a desired property or performance for the composition or formulation in the absence of the modified cyclodextrin (I).

According to a ninth aspect of the invention, there is provided the use of an additive composition according to the first aspect, for the purpose of increasing the cetane number of a diesel fuel formulation or component thereof. The composition may be used to achieve any degree of improvement in the cetane number of the formulation or component, and/or to achieve or exceed a desired target cetane number.

The cetane number of a fuel formulation or component may be determined using any suitable method, for instance the standard test procedure ASTM D613 (ISO 5165, IP 41) which provides a so-called "measured" cetane number obtained under engine running conditions. Alternatively the cetane number may be determined using the more recent "ignition quality test" (IQT) (ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels.

Alternatively, cetane number may be measured by near infrared (NIR) spectroscopy, as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

In an embodiment, the present invention results in a diesel fuel formulation which has a derived cetane number (ASTM D6890) of 40 or greater, or of 45 or 50 or 51 or greater, for example of 55 or 60 or greater, in cases of 65 or 70 or 75 or greater.

The invention may additionally or alternatively be used to adjust any property of a diesel fuel formulation or component thereof which is equivalent to or associated with cetane number, for example to improve its combustion performance (eg to shorten ignition delays, to facilitate cold starting and/or to reduce incomplete combustion and/or associated emissions in a fuel-consuming system running on the fuel formulation or component) and/or to improve fuel economy.

In the context of the present disclosure, "use" of a modified cyclodextrin (I) in a diesel fuel formulation or component thereof means incorporating the cyclodextrin into the formulation or component, typically as a blend (ie a physical mixture) with one or more other diesel fuel components, for example diesel base fuels, and optionally one or more diesel fuel additives, and together with the cetane improver. The cyclodextrin will conveniently—although not necessarily—be incorporated before the formulation or component is introduced into a fuel-consuming system. Instead or in addition, the use of a modified cyclodextrin (I) may involve running a fuel-consuming system, typically an internal combustion engine, on a diesel fuel formulation containing the cyclodextrin, typically by introducing the formulation into a combustion chamber of an engine. It may involve running a vehicle or other apparatus which is driven by a fuel-consuming system, on a diesel fuel formulation containing the cyclodextrin.

"Use" of a modified cyclodextrin (I) in the ways described above may also embrace supplying the cyclodextrin together with instructions for its use in a diesel fuel formulation or component thereof for one or more of the purposes described above in connection with the fifth to the ninth aspects of the invention. The cyclodextrin may itself be supplied as part of a composition which is suitable and/or adapted and/or intended for use as a diesel fuel additive, in particular an additive composition according to the first aspect of the invention, or a premix therefor. In this case, the modified cyclodextrin may be included in such a composition or premix for any one or more of the purposes described above in connection with the fifth to the ninth aspects of the invention.

Thus a modified cyclodextrin (I) may be used, in a diesel fuel formulation or component thereof, in the form of an additive composition according to the first aspect of the invention or a premix therefor. "Use" of a modified cyclodextrin (I) may therefore comprise "use" of the invented additive composition or premix.

"Use" of a modified cyclodextrin (I) in an additive composition means incorporating the cyclodextrin into the composition, typically as a blend (ie a physical mixture) with a cetane improver, one or more solvent carriers and optionally one or more additional diesel fuel additives. The cyclodextrin will conveniently—although not necessarily—be incorporated before the composition is introduced into a diesel fuel formulation or component thereof, or into a diesel fuel-consuming system. It may be incorporated in the form of a premix as described above. Instead or in addition, the use of a modified cyclodextrin (I) may involve running a diesel fuel-consuming system, typically an internal combustion engine, on a diesel fuel formulation containing the cyclodextrin in the additive composition, typically by introducing the formulation into a combustion region of the system. It may involve running a vehicle or other apparatus which is driven by a fuel-consuming system, on a diesel fuel formulation containing the cyclodextrin in the additive composition.

"Use" of a modified cyclodextrin (I) in the ways described above may also embrace supplying the cyclodextrin together with instructions for its use in an additive composition for one or more of the purposes described above in connection with the fifth to the ninth aspects of the invention.

In general, references to "adding" a component to, or "incorporating" a component in, an additive composition or a fuel formulation or component may be taken to embrace addition or incorporation at any point during the production of the composition or formulation or component or at any time prior to its use.

In certain embodiments, the present disclosure may be used to produce at least 1,000 litres of a modified cyclodextrin-containing additive composition or diesel fuel formulation, or at least 5,000 or 10,000 or 20,000 or 50,000 litres.

A diesel fuel formulation according to the invention, or which is prepared or used according to the invention, may be marketed with an indication that it benefits from an improvement due to the inclusion of the modified cyclodextrin (I), in particular improved efficacy, stability, solubility or activity for a cetane improver which is present in the formulation; improved delivery of such a cetane improver; and/or a lower concentration of a cetane improver or other active substance in the formulation. The marketing of such a formulation may comprise an activity selected from (a) providing the formulation in a container that comprises the relevant indication; (b) supplying the formulation with product literature that comprises the indication; (c) providing the indication in a publication or sign (for example at the point of sale) that describes the formulation; and (d) providing the indication in a commercial which is aired for instance on the radio, television or internet. The improvement may be attributed, in such an indication, at least partly to the presence of the modified cyclodextrin (I). The invention may involve assessing the relevant property of the formulation during or after its preparation. It may involve assessing the relevant property both before and after incorporation of the modified cyclodextrin, for example so as to confirm that the modified cyclodextrin contributes to the relevant improvement in the formulation.

An additive composition according to the invention, or which is prepared or used according to the invention, may be marketed with an indication that it benefits from an improvement due to the inclusion of the modified cyclodextrin (I), in particular improved efficacy, stability, solubility or activity for a cetane improver which is present in the composition; improved delivery of such a cetane improver; and/or a lower concentration of a cetane improver or other active substance in the composition. The marketing of such a composition may comprise an activity selected from (a) providing the composition in a container that comprises the relevant indication; (b) supplying the composition with product literature that comprises the indication; (c) providing the indication in a publication or sign (for example at the point of sale) that describes the composition; and (d) providing the indication in a commercial which is aired for instance on the radio, television or internet. The improvement may be attributed, in such an indication, at least partly to the presence of the modified cyclodextrin (I). The invention may involve assessing the relevant property of the composition during or after its preparation. It may involve assessing the relevant property both before and after incorporation of the modified cyclodextrin, for example so as to confirm that the modified cyclodextrin contributes to the relevant improvement in the composition.

Throughout the description and claims of this specification, the words "comprise" and "contain" and variations of the words, for example "comprising" and "comprises", mean "including but not limited to", and do not exclude other moieties, additives, components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith. For example, for the avoidance of doubt, the optional and preferred features (including concentrations) of the modified cyclodextrin (I), the cetane improver and the diesel fuel formulation can apply to all aspects of the invention in which the modified cyclodextrin, the cetane improver or the diesel fuel formulation are mentioned.

Moreover unless stated otherwise, any feature disclosed herein may be replaced by an alternative feature serving the same or a similar purpose.

Where upper and lower limits are quoted for a property, for example for the concentration of an additive or fuel component, then a range of values defined by a combination of any of the upper limits with any of the lower limits may also be implied.

In this specification, references to physical properties such as cyclodextrin, cetane improver, fuel and fuel component properties are—unless stated otherwise—to properties measured under ambient conditions, ie at atmospheric pressure and at a temperature from 16 to 22 or 25° C., or from 18 to 22 or 25° C., for example about 20° C.

Figure 2A:
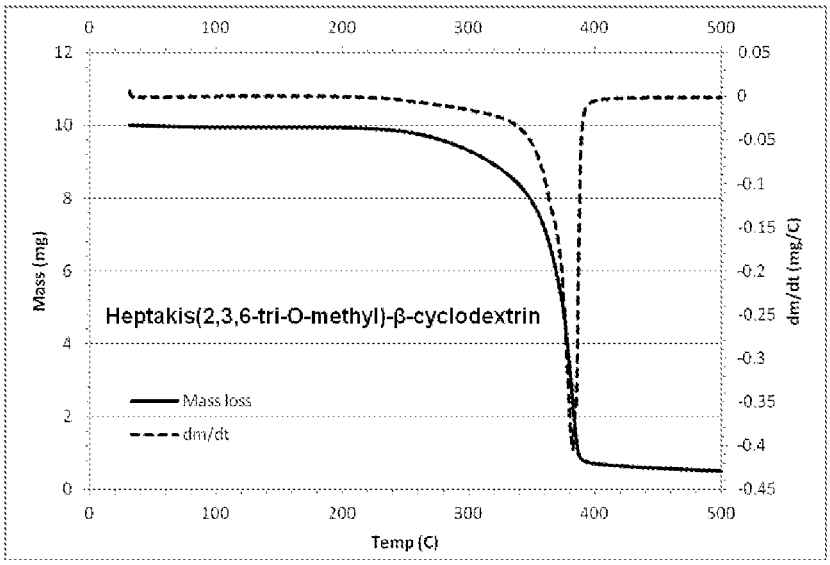
FIGS. 2A to 2C, 3A and 3B are graphs showing the results of the volatilisation experiments conducted in Example 4 below.
Figure 2B:
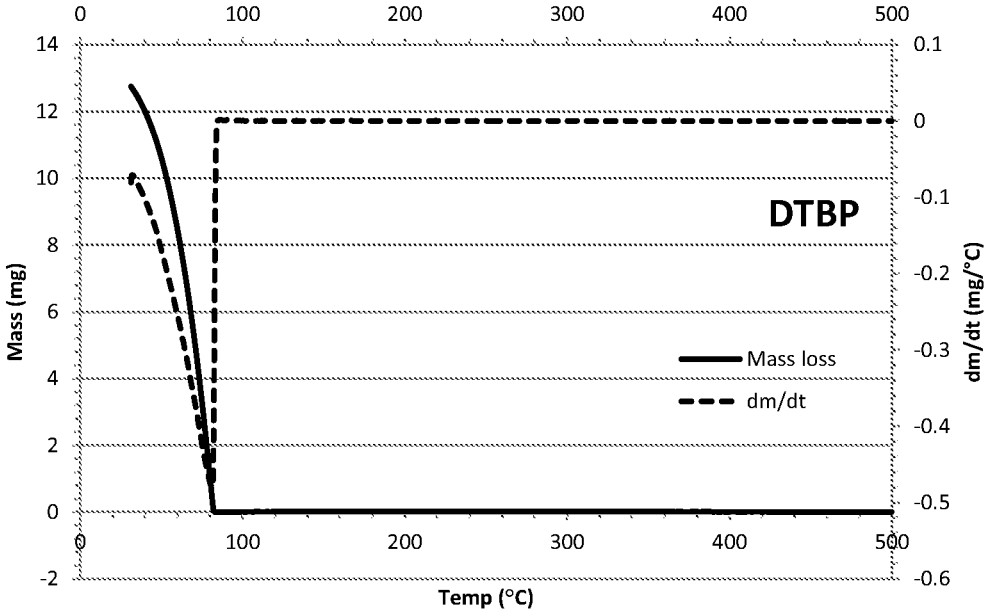
Figure 2C:
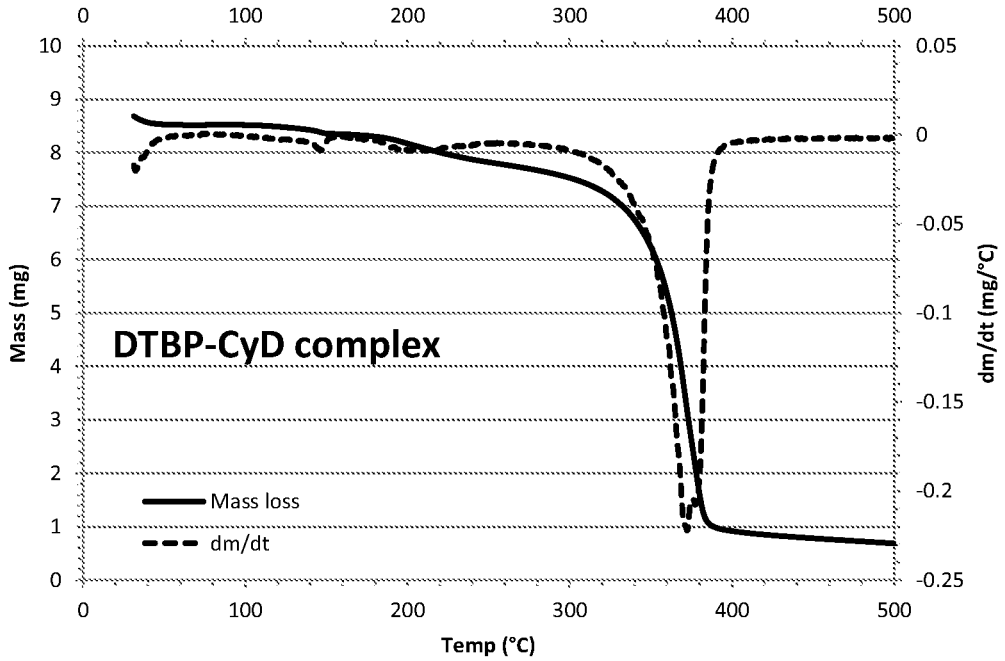
Figures 3A, 3B, 3C:
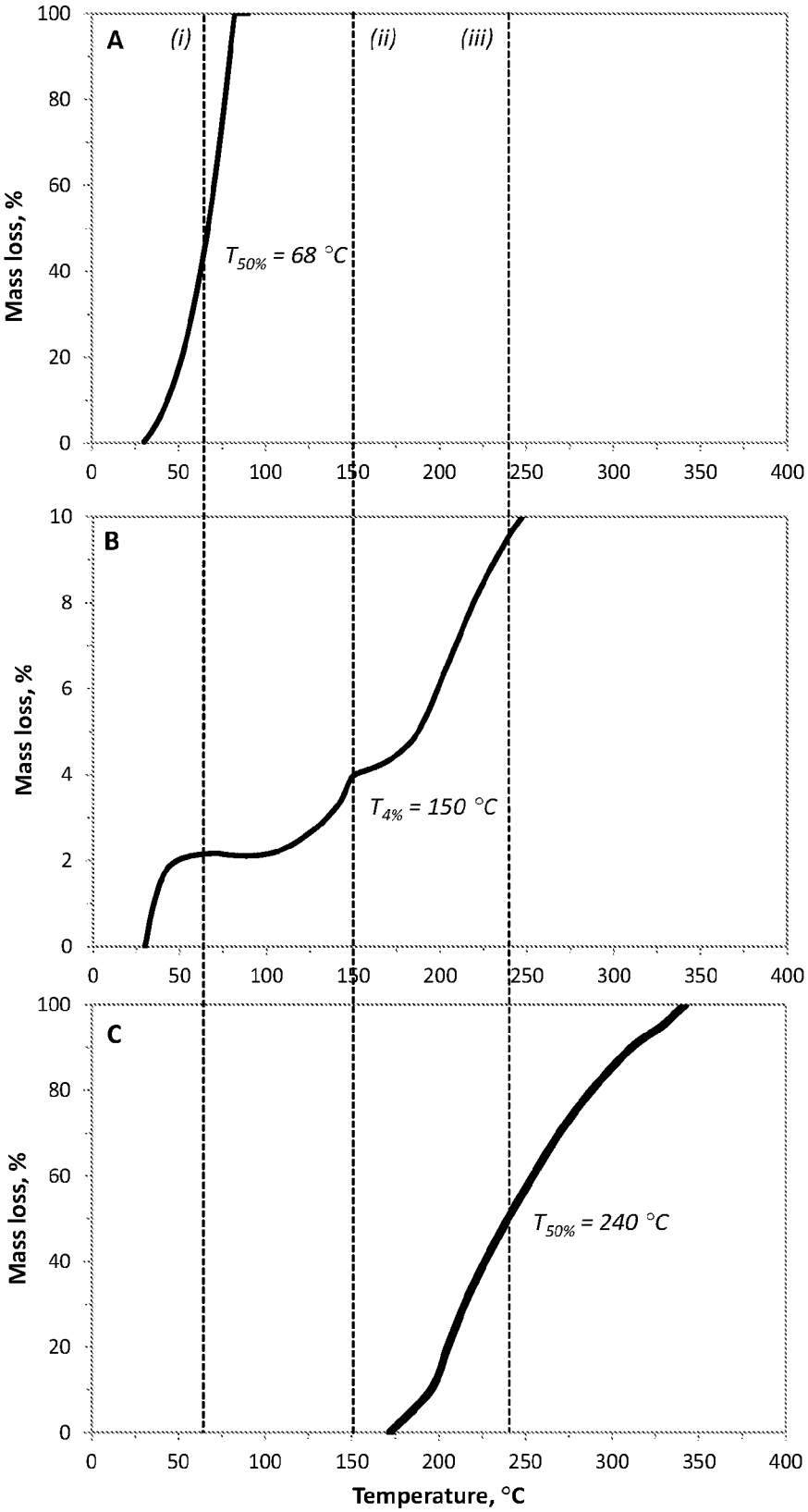
FIG. 3C is a distillation curve for a typical FAME-free diesel fuel, for comparison with FIGS. 3A and 3B as discussed in Example 4.

Embodiments provided by the present disclosure will now be further described with reference to the following non-limiting examples and the accompanying illustrative drawings, of which:

FIGS. 1A to 1D are bar charts showing the results of the cetane number measurements conducted in Examples 1 to 3 below;

FIGS. 2A to 2C, 3A and 3B are graphs showing the results of the volatilisation experiments conducted in Example 4 below; and FIG. 3C is a distillation curve for a typical FAME-free diesel fuel, for comparison with FIGS. 3A and 3B as discussed in Example 4.

EXAMPLES

Example 1

DTBP Additive

A solid additive composition was prepared, in accordance with the invention, by blending a modified cyclodextrin of formula (I) with the known cetane improver di-t-butyl peroxide (DTBP) using the kneading method. The composition had a DTBP concentration of 3.5% w/w, as determined by gas chromatography.

Diesel fuel formulations in accordance with the invention were then prepared by blending the resultant additive composition with a diesel base fuel BF1 at dose rates of both 1,000 ppmw and 10,000 ppmw, corresponding respectively to 35 and 350 ppmw of the DTBP in the finished fuel formulations. The blending was effected by mixing the additive composition into the base fuel, and agitating the mixture until the solid was completely dissolved.

In order to assess the efficacy of the cetane improver in the fuel formulations, the standard test method IP 498/06 was used to measure their IQT cetane numbers. For comparison purposes, IP 498/06 cetane numbers were also measured for the base fuel alone, and for blends of the base fuel with (a) unencapsulated DTBP, ie DTBP in the absence of the modified cyclodextrin, and (b) the cyclodextrin alone.

The base fuel BF1 was a so-called "B7" diesel base fuel containing 7% v/v of the biofuel component POME (palm oil methyl ester). It was sourced from the Shell Group of companies and conformed to the European diesel fuel specification EN 590. It did not contain any detergent or cetane improving additives. Its properties are summarised in Table 1 below.

TABLE 1

| Property | Units | Test method | BF1 |
|---|---|---|---|
| Density @ 15° C. | $kg/m^3$ | ASTM D4052 | 836.1 |
| VK40 | $mm^2/s$ | IP 71 | 2.738 |
| Distillation: | | IP 123 | |
| 0% | ° C. | | 169.8 |
| 10% | | | 195.6 |
| 20% | | | 212.7 |
| 30% | | | 232.6 |
| 40% | | | 254.5 |
| 50% | | | 277.7 |
| 60% | | | 297.1 |
| 70% | | | 312.6 |
| 80% | | | 325.7 |
| 90% | | | 339.2 |
| 95% | | | 350.8 |
| 100% | | | 358.6 |
| Rec at 250° C. | % v/v | | 37.8 |
| Rec at 350° C. | % v/v | | 94.8 |
| Cetane number | | ASTM D613 | 54.0 |

The DTBP was sourced from VWR. The cyclodextrin was (2,3,6-tri-O-methyl)-β-cyclodextrin, ie a cyclodextrin of the formula (I) as defined above, in which n=7 and $R^1$, $R^2$ and $R^3$ are all methyl; it was sourced from Sigma-Aldrich. The DTBP-cyclodextrin complex was sourced from Cyclolab R&D Laboratory (Hungary).

The results of the cetane number measurements are shown in Table 2 below. "CN" refers to cetane number according to IP 498/06; "CyD" refers to the modified cyclodextrin. The "active" concentrations quoted refer to the DTBP alone. The "dose" figures are the concentrations at which either the DTBP or the DTBP-cyclodextrin complex was present in the test fuel formulation. The Δ values represent the change in cetane number compared to that of the base fuel BF1 alone. For calculating the Δ values, the "active" concentrations for the formulations containing only BF1 and/or CyD were taken to be 1.

The results are discussed at the end of Example 3.

Example 2

Carbazole Additive

Example 1 was repeated, but using another known combustion improver, carbazole, in place of the DTBP. The carbazole was sourced from VWR. It was blended with the modified cyclodextrin to give a solid form additive composition having a carbazole concentration of 7.4% w/w, as determined by UV-vis spectroscopy. The carbazole-cyclodextrin complex was sourced from Cyclolab R&D Laboratory (Hungary).

The results of the cetane number measurements are also shown in Table 2. In this context, the "active" concentrations quoted refer to the carbazole (CBZ) alone. The "dose" figures are the concentrations at which either the carbazole or the carbazole-cyclodextrin complex was present in the test fuel formulation. These results are also discussed at the end of Example 3.

Example 3

NMA Additive

Example 1 was repeated, but using N-methyl aniline (NMA) in place of the DTBP. NMA has been used as an octane booster in gasoline fuel formulations, and is therefore known to act as a cetane number suppressant. The NMA was sourced from VWR. It was blended with the modified cyclodextrin to give a solid form additive composition having an NMA concentration of 7.2% w/w, as determined by UV-vis spectroscopy. The NMA-cyclodextrin complex was sourced from Cyclolab R&D Laboratory (Hungary).

The results of the cetane number measurements are also shown in Table 2. In this context, the "active" concentrations quoted refer to the NMA alone, and the "dose" figures are the concentrations at which either the NMA or the NMA-cyclodextrin complex was present in the test fuel formulation. The results are discussed at the end of this example.

TABLE 2

| Test fuel | Additive dose (ppmw) | Active conc" (ppmw) | CN (IQT) (IP 498/06) | Δ CN | Δ CN/ ppmw active |
|---|---|---|---|---|---|
| BF1 | 0 | 0 | 56.2 | 0 | 0 |
| BF1 + CyD | 1,000 | 0 | 56.1 | −0.1 | −0.1 |
| BF1 + CyD | 10,000 | 0 | 56.8 | 0.6 | 0.6 |
| BF1 + DTBP | 1,000 | 1,000 | 58.8 | 2.6 | 0.0026 |
| BF1 + DTBP | 10,000 | 10,000 | 69.9 | 13.7 | 0.00137 |
| BF1 + DTBP-CyD | 1,000 | 35 | 56.3 | 0.1 | 0.002857143 |
| BF1 + DTBP-CyD | 10,000 | 350 | 61.5 | 5.3 | 0.015142857 |
| BF1 + CBZ | 1,000 | 1,000 | 56.3 | 0.1 | 1E−04 |
| BF1 + CBZ | 10,000 | 10,000 | 56.3 | 0.1 | 1E−05 |
| BF1 + CBZ-CyD | 1,000 | 74 | 56.9 | 0.7 | 0.009459459 |
| BF1 + CBZ-CyD | 10,000 | 740 | 61.7 | 5.5 | 0.007432432 |
| BF1 + NMA | 1,000 | 1,000 | 55.8 | −0.4 | −0.0004 |

TABLE 2-continued

| Test fuel | Additive dose (ppmw) | Active conc$^n$ (ppmw) | CN (IQT) (IP 498/06) | Δ CN | Δ CN/ ppmw active |
|---|---|---|---|---|---|
| BF1 + NMA | 10,000 | 10,000 | 54 | −2.2 | −0.00022 |
| BF1 + NMA-CyD | 1,000 | 72 | 55.9 | −0.3 | −0.004166667 |
| BF1 + NMA-CyD | 10,000 | 720 | 57.7 | 1.5 | 0.002083333 |

The Table 2 data are illustrated as bar charts in FIG. 1. FIG. 1A shows the changes in cetane number caused by each of the actives, both with and without the modified cyclodextrin, for BF1 and for the formulations containing 1,000 ppmw of the additive composition. FIG. 1B shows the cetane number changes caused at the 10,000 ppmw additive dose rate. Error bars in FIGS. 1A and 1B represent the measurement error of 0.7 cetane number as described in IP 498/06. FIGS. 1C and 1D show the changes in cetane number per ppmw of active, for the formulations containing, respectively, 1,000 and 10,000 ppmw of the additive composition.

Discussion of Examples 1-3

The results from these examples show that the modified cyclodextrin alone has relatively little effect on the cetane number of the diesel base fuel.

Example 1 shows that the known cetane improver DTBP increases the cetane number of the base fuel, to an extent which depends on its concentration in the overall fuel formulation. When encapsulated in the modified cyclodextrin, the DTBP retains its cetane-enhancing activity (taking account of the actual DTBP concentration when added as part of a larger cyclodextrin complex). This confirms that the modified cyclodextrin (I) is suitable as a vehicle for the additive in the diesel base fuel. Surprisingly, however, the encapsulated DTBP has a greater effect on the base fuel cetane number than when unencapsulated. This increase in activity appears to be greater at the higher additive dose rate, where up to ten times less of the DTBP is necessary to achieve the same cetane number. Here, the potency of the encapsulated DTBP ($1.5\times10^{-2}$ ppmw$^{-1}$) is approximately an order of magnitude greater than that of the unencapsulated DTBP ($1.4\times10^{-3}$ ppmw$^{-1}$).

It is believed, although we do not wish to be bound by this theory, that this effect may be due to an effective reduction in volatility of the DTBP when encapsulated in the modified cyclodextrin (see Example 4). The encapsulated additive may be less likely to evaporate from the fuel formulation prior to the point of combustion, or to degrade within the formulation, resulting in a higher concentration of available additive at the critical time. The high temperatures to which the fuel formulation is exposed at the time of combustion are likely to cause degradation of the cyclodextrin host and volatilisation of the DTBP guest molecules, the DTBP then being available to impart its cetane-boosting effect on the fuel at the time when most needed. Thus, the modified cyclodextrin may be used not only to improve the stability and prolong the effective lifetime of the DTBP additive, but also to target its delivery.

Example 2 shows that carbazole alone has little or no effect on the cetane number of the base fuel. Surprisingly, however, when encapsulated in the modified cyclodextrin, it can significantly increase the base fuel cetane number, in particular at the higher additive dose rate. Thus, a compound which might not otherwise be expected to be of use as a cetane improver—and indeed is in theory better known as an octane booster—can apparently be used as such when combined with a modified cyclodextrin (I). It is believed, although we do not wish to be bound by this theory, that this effect may be due to an effective increase in solubility for the encapsulated additive. Carbazole alone is crystalline and relatively insoluble in diesel. When present as a guest molecule within a more soluble cyclodextrin, it can be better dispersed in a diesel fuel formulation, making it more readily available for imparting a cetane-enhancing effect. Cyclodextrin encapsulation both solubilises the carbazole molecule and inhibits its precipitation, leaving the molecule better able to participate in combustion and oxidation reactions.

NMA alone (Example 3) can be seen to act as a cetane suppressant. However, the combination of the NMA with the modified cyclodextrin surprisingly causes less of a reduction in cetane number, and at the higher additive dose rate can actually yield an overall increase in cetane number. Thus, again, a compound which might not otherwise be expected to be of use as a cetane improver can apparently be used as such when combined with a modified cyclodextrin (I): this can greatly increase the options available to the fuel formulator wishing to produce a diesel fuel with good cetane quality. This effect is particularly surprising since the mechanisms by which a substance acts as either a cetane improver or an octane improver are often complex. Although we do not wish to be bound by this theory, it is believed that the effect may be at least partly due to intermolecular interactions between the NMA and the cyclodextrin, the encapsulation bringing the relevant functional groups into closer proximity. For example, the amine moiety on the NMA may hydrogen bond with the ether moieties of the cyclodextrin, thus altering the electronic structure of the guest molecule and potentially stretching and weakening the N—H bond. In this state, radical formation may occur more readily. Similar effects are likely to be occurring in the carbazole-cyclodextrin system.

It can thus be seen that in accordance with the invention, a modified cyclodextrin (I) can be used as a vehicle for a cetane improving additive in a diesel fuel formulation. Encapsulation of the cetane improver in the cyclodextrin does not appear to be detrimental to its cetane-boosting activity. On the contrary: it can help to solubilise the cetane improver in the fuel formulation, and/or to improve its stability, and in turn to increase its activity. In cases, encapsulation of an additive in a modified cyclodextrin (I) can modify the nature of its activity, causing a cetane-improving effect which might not otherwise be available.

As a result, a potentially wider range of active substances may be available for use as cetane improvers in diesel fuel formulations. Moreover, known cetane improvers such as DTBP may be usable at lower concentrations due to the activity-enhancing effect of a modified cyclodextrin vehicle, and/or due to the ability of the cyclodextrin to target release of the additives.

Example 4

Additive Release

This example demonstrates the temperature-dependent release of an encapsulated cetane improver from a modified cyclodextrin host molecule, and thus the potential to use the cyclodextrin to target release of the cetane improver.

The solid additive composition of Example 1 was subjected to thermogravimetric analysis, to determine the temperature at which the DTBP molecule was released from the inclusion complex. For comparison, the DTBP alone and the cyclodextrin alone were subjected to the same analysis. The results for the three samples are shown in FIGS. 2A (cyclodextrin alone), 2B (DTBP alone) and 2C (inclusion complex). The solid lines show the mass loss with temperature, and the dashed lines the rate of loss of mass with time (ie dm/dt). Mass loss is a useful metric for assessing the thermal evaporation and/or thermal degradation of organic molecules. It can be seen from FIG. 2 that the modified cyclodextrin begins to undergo mass loss at around 250-380° C. Unencapsulated DTBP undergoes mass loss between 40 and 100° C. However, when the active is complexed with cyclodextrin host molecules (FIG. 2C), DTBP mass loss occurs between 150 and 250° C. These increases in mass loss onset temperatures confirm that the DTBP is encapsulated within the cyclodextrin host molecules. More energy is then required to overcome the association between the cyclodextrin and the DTBP, and volatilisation therefore requires a higher temperature. The cetane improver can effectively be protected from evaporation and/or thermal degradation through its encapsulation.

The practical implications of these results can be seen from FIGS. 3A to 3C. FIGS. 3A and 3B show the mass loss for samples of unencapsulated and encapsulated DTBP respectively. FIG. 3C shows the distillation (recovery) curve for a typical FAME-free diesel fuel. The mass loss of unencapsulated DTBP (FIG. 3A) occurs via evaporation and/or thermal degradation, with the temperature of 50% mass loss ($T_{50\%}$) occurring at 68° C. The mass loss of encapsulated DTBP, in contrast, occurs at a higher temperature of 150° C. For the DTBP-CyD complex, a mass loss of 4% represents approximately 50% DTBP mass loss, taking account of the actual DTBP concentration of 3.5% less the start-of-experiment mass drift of 2%.

It can be seen from FIG. 3 that encapsulation suppresses volatility to a temperature range which better overlaps with the diesel light ends. In use in an internal combustion engine, post-ignition, the light ends and the encapsulated (lower volatility) DTBP will be present in the same air-fuel regions and will thus deliver cetane-boosting properties more effectively. The cyclodextrin will also protect the DTBP from premature thermal decomposition, and thus reduce loss. These two mechanisms are believed to contribute to the increased potency observed when the DTBP is complexed with the modified cyclodextrin (I). Example 5 below confirms that such activity-enhancing effects are indeed maintained during use in a diesel engine.

Thus, the cyclodextrin reduces the volatility of the DTBP, effectively delaying its release until the DTBP-cyclodextrin complex dissociates. This can be used to target delivery of the DTBP to a specific temperature regime. For example, the operating temperature within the fuel common rail or injector of a typical diesel engine is likely to be in the range from, respectively, 60 to 150° C. or 60 to 220° C. It is in the combustion chamber of the diesel engine where the effects of a cetane improver are particularly useful. However, an unencapsulated additive such as DTBP could be lost through volatilisation or thermal degradation before reaching the fuel injection equipment. A modified cyclodextrin (I) can be used to delay release of the additive until the point, within the higher temperature fuel injection equipment or combustion chamber, where it is most needed to help improve combustion, thus effectively increasing its efficacy.

At the same time, Examples 1 to 3 and 5 demonstrate that encapsulation of the additive does not significantly impair—indeed, often increases—its cetane improving effects on a fuel formulation.

It has been found that other active substances, including NMA, can benefit from similar enhancements in thermal stability through encapsulation in a modified cyclodextrin of formula (I).

Example 5

EHN Additive

A solid additive composition was prepared, in accordance with the invention, by blending heptakis(2,3,6-tri-O-methyl)-β-cyclodextrin (TRIMEB) with the known cetane improver EHN using the kneading method. The composition had an EHN concentration of 9-10% w/w, as determined by gas chromatography. It was sourced from Cyclolab R&D Laboratory (Hungary).

Diesel fuel formulations in accordance with the invention were then prepared by blending the resultant additive composition with a diesel base fuel BF2 at dose rates of both 2,000 and 4,000 ppmw, corresponding respectively to 200 and 400 ppmw of the EHN in the finished fuel formulations.

The base fuel BF2 was a B7 diesel base fuel containing 7% v/v of POME, sourced from the Shell Group of companies and conforming to the European diesel fuel specification EN 590. It did not contain any detergent or cetane improving additives. Its properties are summarised in Table 3 below.

TABLE 3

| Property | Units | Test method | BF2 |
|---|---|---|---|
| Density @ 15° C. | kg/m$^3$ | ASTM D4052 | 833.8 |
| Distillation: | | IP 123 | |
| 0% | ° C. | | 176.1 |
| 10% | | | 210.8 |
| 20% | | | 225.9 |
| 30% | | | 241.2 |
| 40% | | | 255.3 |
| 50% | | | 268.7 |
| 60% | | | 281.7 |
| 70% | | | 295.7 |
| 80% | | | 311.7 |
| 90% | | | 332.6 |
| 95% | | | 349.2 |
| 100% | | | 358.5 |
| Rec at 250° C. | % v/v | | 36.4 |
| Rec at 350° C. | % v/v | | 95.2 |
| Cetane number | | ASTM D613 | 52.4 |

A further formulation was prepared containing 600 ppmw of the EHN-TRIMEB additive composition and an additional 600 ppmw of EHN, corresponding to a total EHN content of 660 ppmw (including both encapsulated and unencapsulated molecules) in the finished formulation. The blending was effected by mixing the additive composition into the base fuel, and agitating the mixture until the solid was completely dissolved.

In order to assess the efficacy of the cetane improver in the fuel formulations, the standard test method IP 498/06 was used to measure their IQT cetane numbers. In addition, cetane numbers for the formulations were also tested in a research engine, using the standard test method ASTM D613 ("Determination of Ignition Delay and Derived Cetane Number (DCN) of Diesel Fuel Oils by Combustion in a Constant Volume Chamber").

For comparison purposes, both IQT and research engine cetane numbers were also measured for the base fuel alone, and for blends of the base fuel with unencapsulated EHN, ie EHN in the absence of the modified cyclodextrin.

The results of the cetane number measurements are shown in Table 4 below. "DCN (IQT)" refers to cetane numbers according to IP 498/06; "CN (RE)" refers to cetane numbers measured using the research engine; and "EHN-TRIMEB" refers to the host-guest complex formed between the modified cyclodextrin and the EHN additive. The "active" concentrations quoted refer to the EHN alone.

TABLE 4

| Test fuel | EHN conc$^n$ (ppmw) | EHN-TRIMEB conc$^n$ (ppmw) | Active EHN conc$^n$ (ppmw) | DCN (IQT) | CN (RE) |
|---|---|---|---|---|---|
| BF2 | 0 | 0 | 0 | 58.6 | 54.3 |
| BF2 + EHN | 400 | 0 | 400 | 58.7 | 53.8 |
| BF2 + EHN | 600 | 0 | 600 | 59.1 | 55.2 |
| BF2 + EHN | 800 | 0 | 800 | 60.1 | 55.8 |
| BF2 + EHN-TRIMEB | 0 | 2000 | 200 | 58.7 | 55.6 |
| BF2 + EHN-TRIMEB | 0 | 4000 | 400 | 59.6 | 55.7 |
| BF2 + EHN-TRIMEB + EHN | 600 | 600 | 660 | 60.0 | 54.9 |

It can be seen from Table 4 that the EHN continues to function as a cetane improver even when present as a guest molecule within the cyclodextrin inclusion complex. Moreover, its encapsulation appears to enhance its cetane improving activity (compare the figures for the formulations containing (a) 400 ppmw EHN and (b) 4,000 ppmw of the EHN-TRIMEB complex, which equates to 400 ppmw of active EHN).

Example 6

Choice of Modified Cyclodextrin

Two modified cyclodextrins of formula (I), and for comparison an unmodified cyclodextrin, were tested to assess their solubilities and stabilities in diesel fuels.

The cyclodextrins were the TRIMEB used in the previous examples; heptakis(2,6-di-O-n-butyl)-β-cyclodextrin (RABUB); and unmodified β-cyclodextrin ($R^1$=$R^2$=$R^3$=hydrogen). The RABUB was sourced from Cyclolab R&D Laboratory (Hungary) and the unmodified cyclodextrin from Sigma-Aldrich.

The fuels tested were (a) a diesel base fuel and (b) a winter-grade Fischer-Tropsch derived diesel fuel.

In each case, the cyclodextrin was added to the fuel at a concentration of 1,000 ppmw and at room temperature.

The unmodified β-cyclodextrin was found to be insoluble in both the diesel base fuel and the Fischer-Tropsch derived fuel. This demonstrates the unsuitability of the unmodified molecule as an additive or additive vehicle in typical diesel fuel formulations, despite the general reference to cyclodextrins in U.S. Pat. No. 3,314,884.

The TRIMEB formed a clear and bright solution in the diesel base fuel, although it required a long dissolution time. It could be partially dissolved in the Fischer-Tropsch derived fuel, with a longer dissolution time. Thus, the TRIMEB appears to demonstrate higher solubilities in more polar environments.

The RABUB appeared to be very soluble in the diesel fuel, forming a clear and bright solution. It was also the fastest-dissolving of the cyclodextrins tested. Other alkylated β-cyclodextrins, in particular those substituted with C2 or higher alkyl groups, for example C3 to C8 alkyl groups, can therefore also be expected to be soluble in automotive diesel fuels, and to be suitable for use in such fuels as vehicles for cetane improvers and other additives.

Example 7

Solubility of Further Cyclodextrins

Three further modified cyclodextrins of formula (I) were tested for solubility in a diesel base fuel.

The cyclodextrins were alkylated β-cyclodextrins, substituted respectively with ethyl (the compound referred to as RAEB), propyl (RAPB) and octyl (RAOB) groups. In each case the positions $R^1$, $R^2$ and $R^3$ were randomly substituted with the relevant alkyl group, there being on average at least 2 substitutions out of 3 per residue in each molecule. The propyl and octyl substituents were a mixture of linear and branched chain alkyl groups. All three compounds were sourced from Cyclolab R&D Laboratory (Hungary).

The base fuel was a B7 diesel base fuel containing 7% v/v of POME. The cyclodextrins were added to the fuel at a concentration of 1,000 ppmw and at room temperature. The approximate speeds of their dissolution, and the physical appearance of the resultant solutions, were assessed by eye. The observations are summarised in Table 5 below. "Second-scale dissolution time" indicates that the cyclodextrin dissolved in a matter of seconds (ie less than a minute); "minute-scale dissolution time" means that it dissolved within several minutes but less than an hour; "hour-scale" means that it took more than one hour to dissolve.

TABLE 5

| RAEB | RAPB | RAOB |
|---|---|---|
| Clear and bright; hour-scale dissolution time | Clear and bright; second-scale dissolution time | Clear and bright; dissolved on contact |

It can be seen from Table 5 that all of the alkylated cyclodextrins tested had good or at least reasonable solubilities in the diesel fuel. The degree of solubility and speed of dissolution appear to be linked to the respective polarities of the cyclodextrin and the fuel. The polarity of the cyclodextrins increases from low (RAOB) to high (RAEB). In the relatively low polarity B7 diesel fuel, the lowest polarity cyclodextrin RAOB was the easiest to dissolve, as evidenced by its rapid dissolution time. Thus, the substituents on a modified cyclodextrin (I) may be tailored to increase its affinity for a specific type of fuel in which it is intended to be used.

Example 8

Additive Stability

Formulations containing 1,000 ppmw of TRIMEB dissolved in a B7 diesel base fuel were stored at approximately 20° C., −2° C. and −20° C. for a period of six months. At given time intervals across the six-month period, the formulations were allowed to stabilise at room temperature and visually assessed: all were found to be clear and bright, even those stored at the lowest temperature.

These results indicate that modified cyclodextrins of formula (I) can be suitable for use in hydrocarbon-based diesel fuel formulations without solubility or stability issues.

In additional tests, it was found that the inclusion of up to 10,000 ppmw of TRIMEB had no significant effect on the distillation properties of a B7 diesel base fuel.

The results from this and Examples 6 and 7 confirm the utility of modified cyclodextrins of formula (I), in particular alkylated cyclodextrins, as vehicles for cetane improving additives in diesel fuel formulations. They also demonstrate the "tuneability" of the compounds, as the substituents $R^1$ to $R^3$ can be tailored in order to optimise their solubility and stability in any given formulation.

We claim:

1. A diesel fuel formulation comprising an additive composition comprising a cyclodextrin inclusion complex containing:

(i) a cetane improver;

and (ii) a modified cyclodextrin of formula (I):

(I)

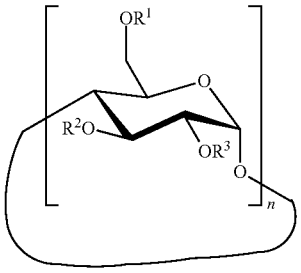

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the cetane improver being present as a guest molecule within a host molecule of the modified cyclodextrin (I), in the form of an inclusion complex.

2. The diesel fuel formulation of claim 1, wherein in the modified cyclodextrin of formula (I), the groups $R^1$, $R^2$ and $R^3$ are independently selected from hydrogen and unsubstituted C1 to C12 alkyl groups.

3. The diesel fuel formulation of claim 2, wherein at least two of $R^1$, $R^2$ and $R^3$ are independently selected from unsubstituted C1 to C12alkyl groups.

4. The diesel fuel formulation of claim 3, wherein two of the groups $R^1$, $R^2$ and $R^3$ are independently selected from unsubstituted C2 to C8alkyl groups.

5. The diesel fuel formulation of claim 1, wherein in the modified cyclodextrin of formula (I), the integer n is from 6 to 8.

6. The diesel fuel formulation of claim 5, wherein n is 7.

7. The diesel fuel formulation of claim 1, wherein the cetane improver is selected from organic nitrates and nitrites; organic (hydro)peroxides; and mixtures thereof.

8. The diesel fuel formulation of claim 1, wherein the cetane improver is an octane booster which, when present as a guest molecule within a host molecule of the modified cyclodextrin (I), is capable of increasing the cetane number of the diesel fuel formulation.

9. The diesel fuel formulation of claim 1, wherein the cetane improver and the modified cyclodextrin (I) are such that the cetane improver is released from the cyclodextrin inclusion complex when the additive composition is subjected to a temperature above or below a predetermined value.

10. The diesel fuel formulation of claim 1, wherein the cetane improver and the modified cyclodextrin (I) are such that the cetane improver is released from the cyclodextrin inclusion complex when the additive composition is subjected to a pressure above or below a predetermined value.

11. The diesel fuel formulation of claim 1, wherein the cetane improver and the modified cyclodextrin (I) are such that the cetane improver is released from the cyclodextrin inclusion complex when the additive composition is exposed to another species.

12. The diesel fuel formulation of claim 1, wherein the concentration of the inclusion complex is from 500 to 1,500 ppmw.

13. A method of introducing a cetane improver to a diesel fuel formulation comprising providing a modified cyclodextrin of formula (I)

(I)

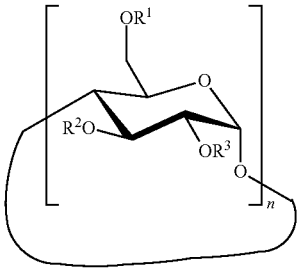

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, as a vehicle for a cetane improver in a diesel fuel formulation.

14. A method comprising:

introducing an additive composition in a diesel fuel formulation into a diesel fuel-consuming system, wherein the additive composition comprises a cyclodextrin inclusion complex containing:

(i) a cetane improver;

and (ii) a modified cyclodextrin of formula (I):

(I)

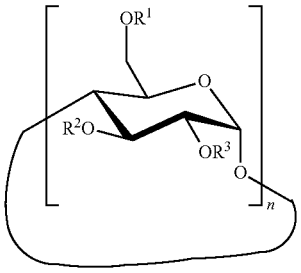

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the cetane improver being present as a guest molecule within a host molecule of the modified cyclodextrin (I), in the form of an inclusion complex; and subsequently subjecting the composition or formulation to a condition which induces at least partial release of the cetane improver from the inclusion complex which it forms with the modified cyclodextrin (I).

* * * * *